US009324312B2

(12) United States Patent
Berker et al.

(10) Patent No.: US 9,324,312 B2
(45) Date of Patent: Apr. 26, 2016

(54) VISCOELASTIC PHONONIC CRYSTAL

(75) Inventors: Ali Berker, St. Paul, MN (US); Manish Jain, El Cerrito, CA (US); Mark D. Purgett, Oakdale, MN (US); Sanat Mohanty, Woodbury, MN (US); Pierre A. Deymier, Tucson, AZ (US); Bassam Merheb, Blaybel (LB)

(73) Assignees: 3M INNOVATIVE PROPERTIES COMPANY, St. Paul, MN (US); THE ARIZONA BOARD OF REGENTS ON BEHALFF OF THE UNIVERSITY OF ARIZONA, Tucson, AZ (US)

( * ) Notice: Subject to any disclaimer, the term of this patent is extended or adjusted under 35 U.S.C. 154(b) by 380 days.

(21) Appl. No.: 12/809,912

(22) PCT Filed: Dec. 15, 2008

(86) PCT No.: PCT/US2008/086823

§ 371 (c)(1),
(2), (4) Date: Jan. 21, 2011

(87) PCT Pub. No.: WO2009/085693

PCT Pub. Date: Jul. 9, 2009

(65) Prior Publication Data

US 2011/0100746 A1 May 5, 2011

Related U.S. Application Data

(60) Provisional application No. 61/015,796, filed on Dec. 21, 2007.

(51) Int. Cl.
*G10K 11/165* (2006.01)
*G10K 11/168* (2006.01)

(Continued)

(52) U.S. Cl.
CPC ..... *G10K 11/165* (2013.01); *E04B 1/82* (2013.01); *E04B 1/84* (2013.01); *E04B 1/86* (2013.01);

(Continued)

(58) Field of Classification Search
CPC ..... E04B 2001/82; E04B 2001/8457; E04B 2001/8461; E04B 2001/84; E04B 1/82; E04B 1/84; E04B 1/86; G10K 11/165; G10K 11/168; G10K 11/172
USPC ..... 181/286, 210, 290
See application file for complete search history.

(56) References Cited

U.S. PATENT DOCUMENTS 1,865,677 A * 7/1932 Cheyney ..... F24F 13/24 138/38
3,298,457 A * 1/1967 Warnaka ..... B32B 15/08 181/290

(Continued)

FOREIGN PATENT DOCUMENTS

CN 1635705 7/2005
CN 1797541 7/2006

(Continued)

OTHER PUBLICATIONS http://www.engineeringtoolbox.com/density-solids-d_1265.html; Densities of Various Solid.*

(Continued)

*Primary Examiner* — David Warren
*Assistant Examiner* — Christina Schreiber
(74) *Attorney, Agent, or Firm* — Merchant & Gould P.C.

(57) ABSTRACT

A sound barrier and method of sound insulation are disclosed. In one aspect of the disclosure, a sound barrier comprises a first, solid medium, such as a viscoelastic solid and a second medium, such as air. At least one of the two media forms a periodic array disposed in the other medium. The solid medium has a speed of propagation of longitudinal sound wave and a speed of propagation of transverse sound wave, the speed of propagation of longitudinal sound wave being at least about 30 times the speed of propagation of transverse sound wave.

12 Claims, 20 Drawing Sheets

(51) Int. Cl.

| | |
|---|---|
| ***G10K 11/172*** | (2006.01) |
| ***E04B 1/82*** | (2006.01) |
| ***E04B 1/84*** | (2006.01) |
| ***E04B 1/86*** | (2006.01) |

(52) U.S. Cl.

CPC ..... *G10K 11/168* (2013.01); *G10K 11/172* (2013.01); *E04B 2001/8457* (2013.01); *E04B 2001/8461* (2013.01); *Y10T 29/49826* (2015.01)

(56) References Cited

U.S. PATENT DOCUMENTS

| | | | | | |
|---|---|---|---|---|---|
| 3,652,360 | A * | 3/1972 | Hartman | C08L 7/00 | 156/244.11 |
| 3,948,009 | A * | 4/1976 | Bernhard | B29B 17/0042 | 181/290 |
| 4,084,367 | A * | 4/1978 | Saylor | B29D 24/005 | 181/292 |
| 4,709,781 | A * | 12/1987 | Scherzer | B32B 15/06 | 156/338 |
| 5,272,284 | A * | 12/1993 | Schmanski | E01F 8/0011 | 181/210 |
| 5,678,363 | A * | 10/1997 | Ogorchock | E01F 8/0029 | 52/144 |
| 6,119,807 | A * | 9/2000 | Benson, Jr. | B32B 17/10 | 181/208 |
| 7,249,653 | B2 * | 7/2007 | Sheng | E04B 1/86 | 181/207 |
| 7,837,008 | B1 * | 11/2010 | Lane | B64G 1/22 | 181/198 |
| 8,132,643 | B2 * | 3/2012 | Berker | G10K 11/165 | 181/210 |
| 8,276,709 | B2 * | 10/2012 | Berker | B60R 13/08 | 181/286 |
| 2005/0000751 | A1 * | 1/2005 | Sheng | E04B 1/86 | 181/290 |
| 2008/0116006 | A1 * | 5/2008 | Doneux | B32B 5/02 | 181/286 |
| 2008/0164093 | A1 * | 7/2008 | Hirai | B32B 5/18 | 181/290 |
| 2009/0045008 | A1 * | 2/2009 | Fisk | B32B 15/082 | 181/286 |
| 2009/0277716 | A1 * | 11/2009 | Eadara | B32B 7/02 | 181/290 |
| 2010/0090161 | A1 * | 4/2010 | Mason | B29C 39/006 | 252/182.11 |
| 2010/0288580 | A1 * | 11/2010 | Berker | G10K 11/165 | 181/210 |
| 2011/0000741 | A1 * | 1/2011 | Berker | F24F 13/0263 | 181/296 |
| 2011/0005859 | A1 * | 1/2011 | Berker | F24F 13/0263 | 181/224 |
| 2011/0100746 | A1 * | 5/2011 | Berker | G10K 11/165 | 181/286 |
| 2011/0247893 | A1 * | 10/2011 | Berker | B60R 13/08 | 181/286 |
| 2011/0253153 | A1 * | 10/2011 | Berker | G10K 11/165 | 128/866 |
| 2012/0000726 | A1 * | 1/2012 | Deymier | G10K 11/165 | 181/176 |
| 2012/0090916 | A1 * | 4/2012 | Berker | B32B 5/18 | 181/292 |
| 2014/0097562 | A1 * | 4/2014 | Boechler | F16F 7/015 | 267/140.13 |
| 2014/0170392 | A1 * | 6/2014 | Allen | F16L 59/029 | 428/189 |

FOREIGN PATENT DOCUMENTS

| | | | | |
|---|---|---|---|---|
| EP | 1 859 928 | | 11/2007 | |
| EP | 1859928 | A1 * | 11/2007 | E01F 8/00 |
| JP | 02298619 | A * | 12/1990 | |
| JP | 06032939 | | 2/1994 | |
| JP | 06169498 | | 6/1994 | |
| JP | 2006-106211 | | 4/2006 | |
| JP | 2006-257993 | | 9/2006 | |
| JP | 2006-284658 | | 10/2006 | |
| JP | 2006-335938 | | 12/2006 | |
| JP | 2007-015292 | | 1/2007 | |
| JP | EP 1859928 | A1 * | 11/2007 | B32B 5/18 |
| WO | WO 2006/021004 | | 2/2006 | |
| WO | WO 2006/116440 | | 11/2006 | |
| WO | WO 2006/119895 | | 11/2006 | |
| WO | WO 2009085724 | A1 * | 7/2009 | G10K 11/165 |

OTHER PUBLICATIONS

Ivansson "Sound absorption by viscoelastic coatings with periodically distributed cavities." *J. Acoust. Soc. Am.* vol. 119. No. 6. 2006. pp. 3558-3567.

Zhao et al. "Dynamics and sound attenuation in viscoelastic polymer containing hollow glass microspheres." *J. of Applied Physics.* vol. 101. 2007. pp. 123518-1-123518-3.

Hsu et al. "Lamb waves in binary locally resonant phonoic plates with two-dimntionsal lattices." *Applied Physics Letters.* vol. 90. 2007. pp. 201904-1-201904-3.

Goffaux. "Comparison of the sound attenuation efficiency of locally resonant materials and elastic band-gap structures." *Physical Review B.* vol. 70. 2004. 184302-1-184302-6.

Baird et al. "Wave propagation in a viscoelastic medium containing fluid-filled microspheres." *J. Acoust. Soc. Am.* vol. 105. No. 3. 1999. pp. 1527-1538.

Ko et al. "Application of Elasstomeric material to the reduction of turbulent boundary layer pressure fluctuations (Three-Dimensional Analysis)." *J. of Sound and Vibration.* vol. 159. No. 3. 1992. pp. 469-481.

Merheb et al. "Elastic and viscoelastic effects in rubber/air acoustic band gap structures: A theoretical and experimental study." *J. of Applied Physics.* vol. 104. 2008. pp. 604913-1-604913-9.

Sigalas, M., et al., "Classical vibrational modes in phononic lattices: theory and experiment," Z. Kristallogr, vol. 220, pp. 765-809 (2005).

J.O. Vasseur, P.A. Deymier, A. Khelif, Ph. Lambin, B. Dajfari-Rouhani, A. Akjouj, L. Dobrzynski, N. Fettouhi, and J. Zemmouri, "Phononic crystal with low filling fraction and absolute acoustic band gap in the audible frequency range: A theoretical and experimental study," Phys. Rev. E 65, 056608-1-056608-6 (May 2, 2002).

Ph. Lambin, A. Khelif, J.O. Vasseur, L. Dobrzynski, and B. Djafari-Rouhani, "Stopping of acoustic waves by sonic polymer-fluid composites," Phys. Rev. E, vol. 63, pp. 066605-1-066605-6 (May 22, 2001).

Z. Liu et al., "Locally Resonant Sonic Materials", Science Magazine, vol. 289, pp. 1734-1736 (Sep. 8, 2000).

I.E. Psarobas, "Viscoelastic response of sonic band-gap materials," Phys. Rev. B vol. 64, pp. 012303-1-012303-4 (Jun. 15, 2001).

Tanaka et al., "Band structure of acoustic waves in phononic lattices: Two-dimensional composites with large acoustic mismatch." *Physical Review B*, vol. 61, No. 11, pp. 7387-7392 (Mar. 2000).

J.O. Vasseur et al., "Experimental evidence for the existence of absolute acoustic band gaps in two-dimensional periodic composite media", Journal Physics: Condens, Matter 10, PII: S0953-8984(98)93210-6, pp. 6051-6064 (Apr. 9, 1998).

Ivansson, "Sound absorption by viscoelastic coatings with periodically distributed cavities," J. Acoust. Society of America, vol. 119, No. 6, pp. 3558-3567 (Jun. 2006).

Zhao et al., "Dynamics and sound attenuation in viscoelastic polymer containing hollow glass microspheres," J. of Applied Physics., vol. 101, No. 12, pp. 123518-1-123518-3 (Jun. 25, 2007).

Hsu et al., "Lamb waves in binary locally resonant phononic plates with two-dimensional lattices," Applied Physics Letters, vol. 90, No. 20, pp. 201904-1-201904-3, ISSN: 0003-6951 (May 15, 2007).

Goffaux et al., "Comparison of the sound attenuation efficiency of locally resonant materials and elastic band-gap structures," Physical Review B, vol. 70, 184302-1-184302-6 (Nov. 18, 2004).

Baird et al., "Wave propagation in a viscoelastic medium containing fluid-filled microspheres," J. Acoust. Soc. Am., vol. 105, No. 3, pp. 1527-1538 (Mar. 1, 1999).

(56) References Cited

OTHER PUBLICATIONS

Ko et al., "Application of Elastomeric material to the reduction of turbulent boundary layer pressure fluctuations (Three-Dimensional Analysis)," J. of Sound and Vibration, vol. 159, No. 3, pp. 469-481 (Dec. 22, 1992).

Merheb et al., "Elastic and viscoelastic effects in rubber/air acoustic band gap structures: A theoretical and experimental study," J. of Applied Physics. vol. 104, pp. 604913-1-604913-9 (Sep. 25, 2008).

International Search Report for PCT/US2008/086918, International Filing Date: Dec. 16, 2008.

European Search Report mailed Mar. 16, 2012.

http://www.engineeringtoolbox.com/density-solids-dl265.html.; "Densities of Various Solids"; retrieved on Apr. 1, 2011; 5 pgs.

* cited by examiner

VISCOELASTIC PHONONIC CRYSTAL

This application is being filed on 21 Jun. 2010, as a US National Stage of PCT International Patent application No. PCT/US2008/086823, filed 15 Dec. 2008 in the name of 3M Innovative Properties Company, a U.S. national corporation, and The Arizona Board of Regents, a U.S. University, applicant for the designation of all countries except the US, and Ali Berker, a citizen of the U.S., Manish Jain, a citizen of India, Mark D. Purgett, a citizen of the U.S., Sanat Mohanty, a citizen of India, Pierre A. Deymier, a citizen of France, and Bassam Merheb, a citizen of France and Lebanon, applicants for the designation of the US only, and claims priority to U.S. Provisional Patent Application Ser. No. 61/015,796, filed Dec. 21, 2007. To the extent appropriate, a claim of priority is made to each of the above disclosed applications.

TECHNICAL FIELD

This disclosure relates to sound barriers. Specific arrangements also relate to sound barriers using phononic crystals.

BACKGROUND

Sound proofing materials and structures have important applications in the acoustic industry. Traditional materials used in the industry, such as absorbers, reflectors and barriers, are usually active over a broad range of frequencies without providing frequency selective sound control. Active noise cancellation equipment allows for frequency selective sound attenuation, but it is typically most effective in confined spaces and requires the investment in, and operation of, electronic equipment to provide power and control.

Phononic crystals, i.e. periodic inhomogeneous media, have been used as sound barriers with acoustic passbands and band gaps. For example, periodic arrays of copper tubes in air, periodic arrays of composite elements having high density centers covered in soft elastic materials, and periodic arrays of water in air have been used to create sound barriers with frequency-selective characteristics. However, these approaches typically suffer from drawbacks such as producing narrow band gaps or band gaps at frequencies too high for audio applications, and/or requiring bulky physical structures.

There is thus a need for improved sound barriers with diminished drawback of the traditional technologies.

SUMMARY

The present disclosure relates generally to sound barriers, and in certain aspects more specifically relates to phononic crystals constructed with viscoelastic materials.

In one aspect of the disclosure, a sound barrier comprises (a) a first medium having a first density, and (b) a substantially periodic array of structures disposed in the first medium, the structures being made of a second medium having a second density different from the first density. At least one of the first and second media is a solid medium, such as a solid viscoelastic silicone rubber, having a speed of propagation of longitudinal sound wave and a speed of propagation of transverse sound wave, where the speed of propagation of longitudinal sound wave is at least about 30 times the speed of propagation of transverse sound wave.

As used in this disclosure, a "solid medium" is a medium for which the steady relaxation modulus tends to a finite, nonzero value in the limit of long times.

A further aspect of the present disclosure relates to a method of making a sound barrier. In one configuration, the method comprises (a) selecting a first candidate medium comprising a viscoelastic material having a speed of propagation of longitudinal sound wave, a speed of propagation of transverse sound wave, a plurality of relaxation time constants; (b) selecting a second candidate medium; (c) based at least in part on the plurality of relaxation time constants, determining an acoustic transmission property of a sound barrier comprising a substantially periodic array one of the first and second candidate media embedded in the other one of the first and second candidate media; and determining whether the first and second media are to be used to construct a sound barrier based at least in part on the result of determining the acoustic transmission property.

In one example, at least one of the first and second media comprises a viscoelastic material that has a combination of viscoelasticity coefficient and viscosity sufficient to produce an acoustic band gap from about 4 kHz or lower through about 20 kHz or higher, a transmission coefficient of longitudinal sound waves of frequencies within the band gap being not greater than about 0.05 when the barrier has a thickness of not greater than about 20 cm. In some cases, the combination of viscoelasticity coefficient and viscosity, and the configuration of the substantially periodic array, is sufficient to produce an acoustic band gap from about 4 kHz or lower through about 20 kHz or higher, a transmission amplitude of longitudinal sound waves for frequencies within the band gap being smaller by a factor of at least about 10 than a transmission amplitude of longitudinal sound waves for the frequencies through a reference sound barrier that has a homogeneous structure and has the same dimensions and made of an elastic or viscoelastic material having the same elastic properties as the medium comprising the viscoelastic material.

BRIEF DESCRIPTION OF THE DRAWINGS

FIG. 5(*b*) shows a more detailed portion of the plot shown in FIG. 5(*a*).

FIG. 8(*b*) shows a more detailed region in the plot in FIG. 8(*a*).

FIG. 12(*b*) show the details of a portion of the plot in FIG. 12(*a*).

FIG. 15(*b*) show the details of a portion of the plot in FIG. 15(*a*).

FIG. 16(*b*) shows a comparison of the transmission amplitude spectra in elastic rubber, silicone viscoelastic rubber and the composite structure of air cylinders in silicone rubber-air.

DETAILED DESCRIPTION

I. Overview

Figure 1:
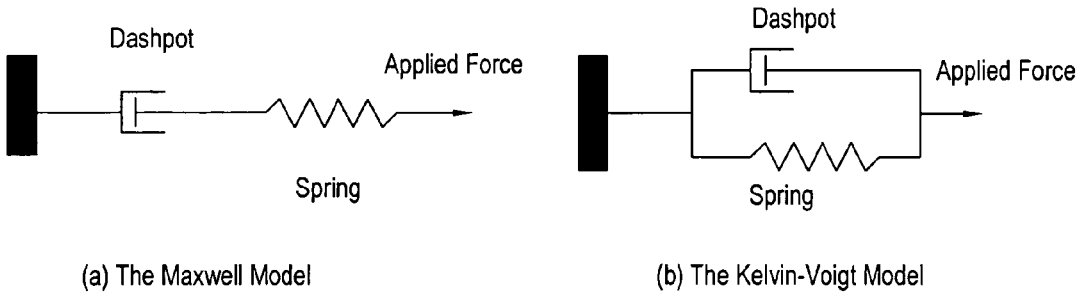
FIG. 1 is an illustration of the Maxwell and Kelvin-Voigt Models.

This disclosure relates to phononic crystals for frequency-selective blocking of acoustic waves, especially those in the audio frequency range.

The challenge for sound insulation is the design of structures that prevent the propagation of sound over distances that are smaller than or on the order of the wavelength in air. At least two approaches have been used in the development of such materials. The first one relies on Bragg scattering of elastic waves by a periodic array of inclusions in a matrix. The existence of band gaps depends on the contrast in the physical and elastic properties of the inclusions and matrix materials, the filling fraction of inclusions, the geometry of the array and inclusions. Spectral gaps at low frequencies can be obtained in the case of arrays with large periods (and large inclusions) and materials with low speed of sound. For example, a significant acoustic gap in the range 4-7 kHz was obtained in a square array (30 mm period) of hollow copper cylinder (28 mm diameter) in air for the propagation of acoustic waves along the direction parallel to the edge of the square unit cell. See, J. O. Vasseur, P. A. Deymier, A. Khelif, Ph. Lambin, B. Dajfari-Rouhani, A. Akjouj, L. Dobrzynski, N. Fettouhi, and J. Zemmouri, "Phononic crystal with low filling fraction and absolute acoustic band gap in the audible frequency range: A theoretical and experimental study," *Phys. Rev. E* 65, 056608 (2002). Composite water/air media show wide stop bands extending down to 1 kHz for centimeter size structures. See, Ph. Lambin, A. Khelif, J. O. Vasseur, L. Dobrzynski, and B. Djafari-Rouhani, "Stopping of acoustic waves by sonic polymer-fluid composites," *Phys. Rev. E* 63, 06605 (2001). The second approach uses structures composed of heavy inclusions coated with a soft elastic material (so-called "locally resonant material"), which possesses resonances. See, Z. Liu, X. Zhang, Y. Mao, Y. Y. Zhu, Z. Yang, C. T. Chan, P. Sheng, *Science* 289, 1734 (2000). Although the frequency of resonance was reported to be very low (two orders of magnitude below the Bragg frequency), the associated band gaps are narrow. In order to achieve broad stop bands one would need to superpose different resonant structures.

Thus while the structures described in the literature show predicted (and in a few cases experimentally demonstrated) band gaps, they typically have been effective for ultrasound frequencies (20 kHz+ to GHz). When audible frequency control was targeted the structures have been large (such as metal pipes with a diameter of several cm, which are arranged in an array with external dimensions of decimeters or meters) and heavy. Hence, the challenge for audible frequency control is to design and build structures that are reasonable in external dimensions (centimeters or less) and light in weight.

According to certain aspects of the present disclosure, certain materials, including linear viscoelastic materials, some commercially available, can be used to construct phononic crystal structures with band gaps in the audible range, that are both light weight and have external dimensions on the order of a few centimeters or less. By controlling the design parameters, the frequency of the band gap, the number of gaps, and their width can be tuned. The design parameters include:

- Type of the lattice (e.g., 2-dimensional (2D): square, triangular, etc.; 3-dimensional (3D): face-centered cubic (fcc), body-centered cubic (bcc), etc.)
- Spacing between the sites (the lattice constant, a) (for example, a periodicity of not greater than about 30 mm in at least one dimension).
- Make-up and shape of the unit cell (e.g., in 2D, the fractional area of the unit cell that is occupied by the inclusion—also known as the fill factor, f).
- Physical properties of the inclusion and the matrix materials (examples of physical properties include density, Poisson's ratio, various moduli, speeds of sound in longitudinal and transverse modes, respectively; for example, in a sound barrier having a substantially periodic array of structures disposed in the first medium, the structures being made of a second medium, at least one of the first and second media can be a solid medium including a viscoelastic material, and the other medium can include a gas phase material; as another example, each of the array of structures can comprise an element no larger than about 10 mm in at least one dimension.)

Shape of the inclusion (e.g. rod, sphere, hollow rod, square pillar).

In one aspect of the present disclosure, rubber/air acoustic band gap (ABG) structures with small dimensions are discussed that can attenuate longitudinal sound waves over a very wide range of audible frequencies with a lower gap edge below 1 kHz. These ABG structures do not necessarily exhibit absolute band gaps. However, since the transverse speed of sound in rubber can be nearly two orders of magnitude lower than that of longitudinal waves, leading to an effective decoupling of the longitudinal and transverse modes-, these solid/fluid composites have been found to behave essentially like a fluid/fluid system for the transmission of longitudinal waves. These rubber/air ABG structures can therefore be used as effective sound barriers.

More generally, a viscoelastic medium can be used to construct phononic crystals. According to another aspect of the present disclosure, acoustic properties of the phononic crystals can be selected at least in part by predicting, using computer modeling, the effect of viscoelasticity on the transmission spectrum of these composite media. For example, finite difference time domain method (FDTD) can be used for the calculation of the transmission spectra and acoustic band structure in inhomogeneous viscoelastic media. Furthermore, multiple relaxation times that typically exist in a viscoelastic material can be used as a basis to calculate spectral response using models such as a generalized Maxwell model in conjunction with the compressible general linear viscoelastic fluid constitutive relation for the viscoelastic media.

In another aspect of the present disclosure, unlike the conventional elastic-elastic phononic crystals, where the denser phase is embedded in a matrix of lighter medium, air cylinders are used as the inclusions embedded in a matrix of linear viscoelastic material.

II. Example Configurations

A. Material Selection

According to one aspect of the present disclosure, the materials for constructing phononic crystals in the audible region is chosen to have low sound speed propagation characteristics. This follows as a consequence of Bragg's rule which states that the central frequency of the band gap is directly proportional to the average wave speed propagating through the crystal. Note also that, for a given frequency, the wavelength of the sound wave will decrease as the sound speed decreases. It is believed that shorter wavelengths allow for more interaction of the pressure wave with the smaller structures, allowing for making phononic crystals with audible frequency activity and external dimensions on the order of centimeters or less. Materials with both low modulus and high density can be useful since they have low sound speeds, but typically as the modulus decreases, so does the density. Certain rubbers, gels, foams, and the like can be materials of choice given the combination of the above-described desirable characteristics.

Certain commercially available viscoelastic materials have properties that make them potentially attractive candidate materials: One, their mechanical response will vary over different frequencies that makes them suitable for tailored applications. Two, they provide an additional dissipative mechanism that is absent in linear elastic materials. Three, while the longitudinal speed of sound in these materials is typically on the order of 1000 m/s, it has been observed that their transverse sound speeds can be an order of magnitude or more smaller than the longitudinal speeds. While an elastic material whose moduli are constant with respect to frequency has constant longitudinal and transverse speeds over different frequencies, linear viscoelastic materials have (dynamic) moduli that decrease with decreasing frequency. This implies desirable lower speeds at the acoustically lower frequencies.

These phenomena observed in linear viscoelastic materials are in stark contrast to the behavior of linear elastic materials. Phononic crystals containing viscoelastic materials thus behave differently and acoustically better than their purely elastic counterparts. More specifically, viscoelasticity can shift the central frequencies of the band gaps to lower values as well as widen the band gaps.

B. Design of Viscoelastic Phononic Crystals by Computer Modeling

In another aspect of the present disclosure, computer modeling is used to design phononic crystals, taking into account multiple characteristic relaxation times existing in viscoelastic materials. In one configuration, FDTD method, which involves transforming the governing differential equations in the time domain into finite differences and solving them as one marches out in time in small increments, is used to calculate acoustic properties of sound barriers using multi-element models. For a detailed description of the process of design of viscoelastic phononic crystal sound barriers using computer modeling, see Appendix.

In one aspect of the present disclosure, propagation of elastic and viscoelastic waves in solid/solid and solid/fluid periodic 2D binary composite systems is calculated. These periodic systems are modeled as arrays of infinite cylinders (e.g., with circular cross section) made of isotropic materials, A, embedded in an isotropic material (matrix) B. The cylinders, of diameter d, are assumed to be parallel to the Z axis of the Cartesian coordinate (OXYZ). The array is then considered infinite in the two directions X and Z and finite in the direction of propagation of probing wave (Y). The intersections of the cylinder axes with the (XOY) transverse plane form a two-dimensional periodic array of specific geometry. The stimulus (input signal) sound wave is taken as a cosine-modulated Gaussian waveform. This gives rise to a broadband signal with a central frequency of 500 kHz.

As examples, calculations are done for two structures. The first structure is composed of a rubber-like viscoelastic material (polysilicone rubber) of density=1260 kg/m$^3$, longitudinal speed=1200 m/s, and transverse speed=20 m/s.

Figure 3:
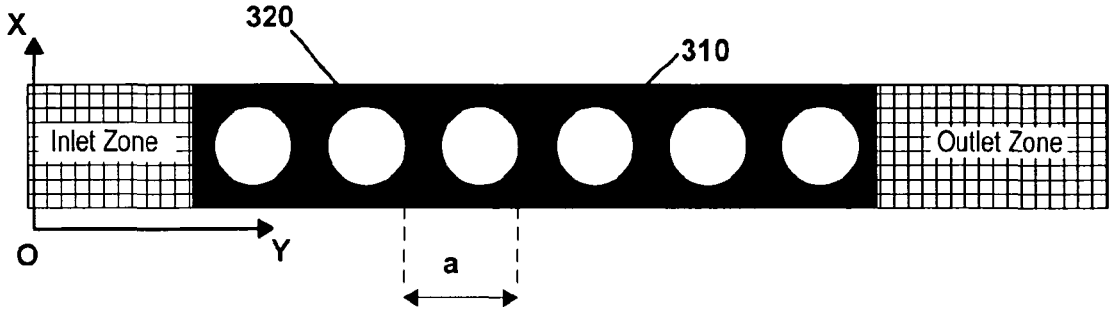
FIG. 3 schematically shows a cross section of a two-dimensional array of air cylinders embedded in a polymer matrix according to one aspect of the present disclosure. The cylinders are parallel to the Z axis of the Cartesian coordinate system (OXYZ). Lattice constant a=12 mm; cylinders diameter D=8 mm.

The inclusions in the viscoelastic matrix 310 are cylinders 320 of air (FIG. 3). In order to be able to apply the Mur boundary absorption conditions, inlet and outlet zones are added on both ends of the sample along the Y directions by setting "$\alpha_0$=1" in those regions. These regions then behave like elastic media and the Mur conditions remain unchanged. Note that the transition from the elastic to the viscoelastic zone will however lead to some reflections of acoustic waves. In this model, the lattice parameter "a" is equal to 12 mm and the diameter of cylinder is 8 mm.

Figure 4:
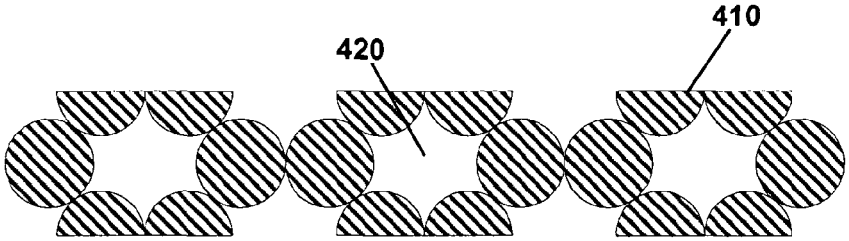
FIG. 4 schematically shows a cross section of a two-dimensional array of polymer cylinders located on a honeycomb lattice embedded in air according to another aspect of the present disclosure. The cylinders are parallel to the Z axis of the Cartesian coordinate system (OXYZ). Vertical lattice constant b=19.9 mm; horizontal lattice constant a=34.5 mm; and cylinder diameter D=11.5 mm.

The second structure is represented in FIG. 4. It consists of air matrix 410 within which is embedded an array of touching polymer cylinders 420 located on a honeycomb lattice with hexagon edge size 11.5 mm (cylinders radius 5.75 mm, hexagon lattice parameter 19.9 mm). The overall thickness of the structure normal to the wave propagation direction is 103.5 mm. The cylinders are made of the same polymer as before and the outside medium is air.

C. Examples of Physical Sound Barriers

In one aspect of the present disclosure, experimental measurements are carried out on a sample of binary composite materials constituted of a square array of 36 (6×6) parallel cylinders of air embedded in a polymer matrix. The polymer is a silicone rubber (Dow Corning® HS II RTV High Strength Mold Making Silicone Rubber, available from Ellsworth Adhesives, Germantown, Wis.; also available at: http://www.ellsworth.com/display/productdetail.html?productid=425&Tab=Vendors). The lattice is 12 mm and the diameter of the cylinder is 8 mm. The physical dimension of the sample is 8×8×8 cm. The measured physical properties of the polymer are: Density=1260 kg/m$^3$ and longitudinal speed of sound=1200 m/s. The transverse speed of sound in this material is estimated to be approximately 20 m/sec from published data on physical constants of different rubbers. See, for example, Polymer Handbook, 3rd Edition, Edited by J. Brandup & E. H. Immergut, Wiley, N.Y. 1989.

The ultrasonic emission source used in the experiment is a Panametrics delta broad-band 500 kHz P-transducer with pulser/receiver model 500PR. The measurement of the signal is performed with a Tektronix TDS 540 oscilloscope equipped with GPIB data acquisition card. The measured transmitted signals are acquired by LabView via the GPIB card, then processed (averaging and Fourier Transform) by a computer.

The cylindrical transducers (with a diameter of 3.175 cm) are centered on the face of the composite specimen. The emission source produces compression waves (P-waves) and the receiving transducer detects only the longitudinal component of the transmitted wave. The longitudinal speed of sound is measured by the standard method of time delay between the pulse sent and the signal received.

D. Example Results of Calculated and Actual Properties

1. Rubber Matrix/Air Inclusions a. Transmission in Rubber/Air Structure i. Elastic FDTD FIGS. 5(*a*) and (*b*) present the computed FDTD transmission coefficient through the 2D array of air cylinders embedded in a polymer matrix. Here we have chosen $\alpha_0$=1.0, which is the limit of elastic materials. This transmission spectrum was obtained by solving the General Linear Viscoelastic equations (25), (26) and (27) over $2^{21}$ time steps, with each time step lasting 7.3 ns. The space is discretized in both the X and Y directions with a mesh interval of $5\times10^{-5}$ m. The transmission coefficient is calculated as the ratio of the spectral power transmitted in the composite to that transmitted in an elastic homogeneous medium composed of the matrix material.

Figure 5A:
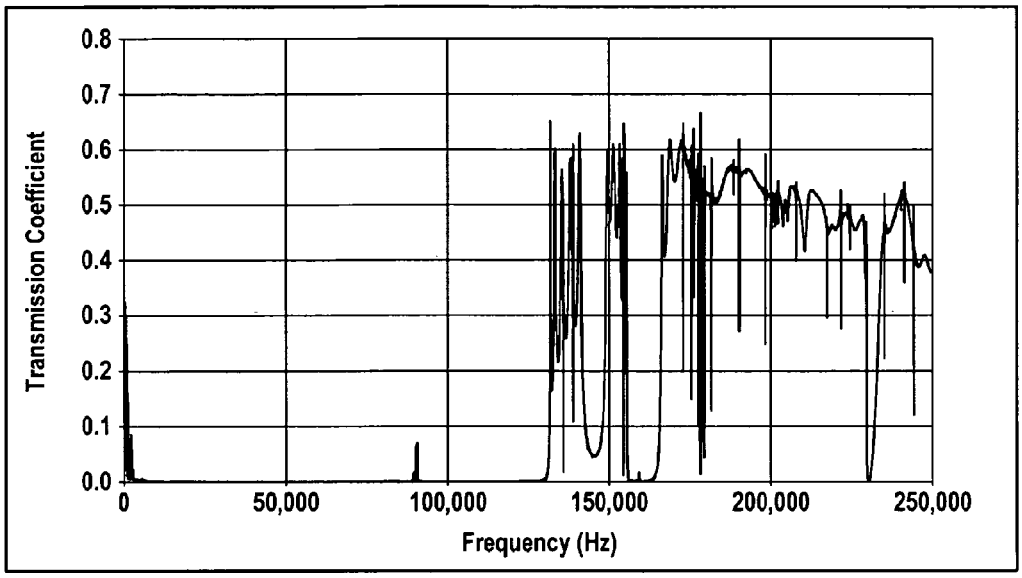
FIG. 5(*a*) shows the spectral transmission coefficient calculated for the array of air cylinders in a polymer matrix.
Figure 5B:
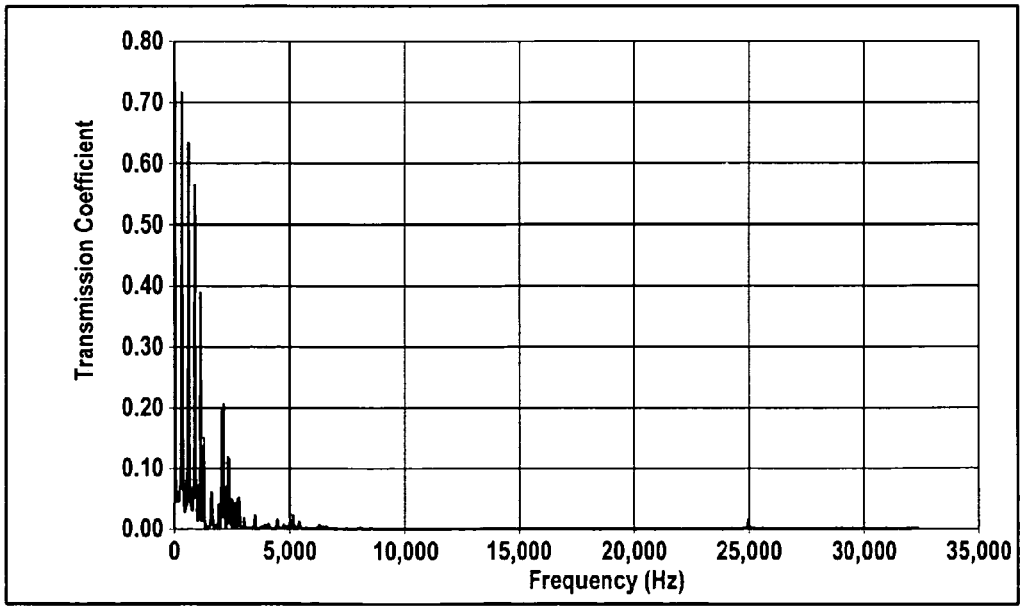

Notice on the spectrum of FIG. 5(*a*) two band gaps. The most important one is from around 1.5 kHz to 87 kHz; the second gap is from 90 kHz to 125 kHz. Note also in the spectrum of FIG. 5(*a*) that transmission bands show sharp narrow drops at well defined frequencies. These drops in transmission result from hybridization of the composite bands with flat bands corresponding to the modes of vibration of cylinders of air. The frequencies at which these flat bands occur can be obtained from the zeros of the first derivative of the Bessel function of the first kind, $J'_m(\omega r/c)=0$ where c is the speed of sound in air, r is the radius of the air cylinder and m is the order of the Bessel function.

ii. Measurements

Figure 6:
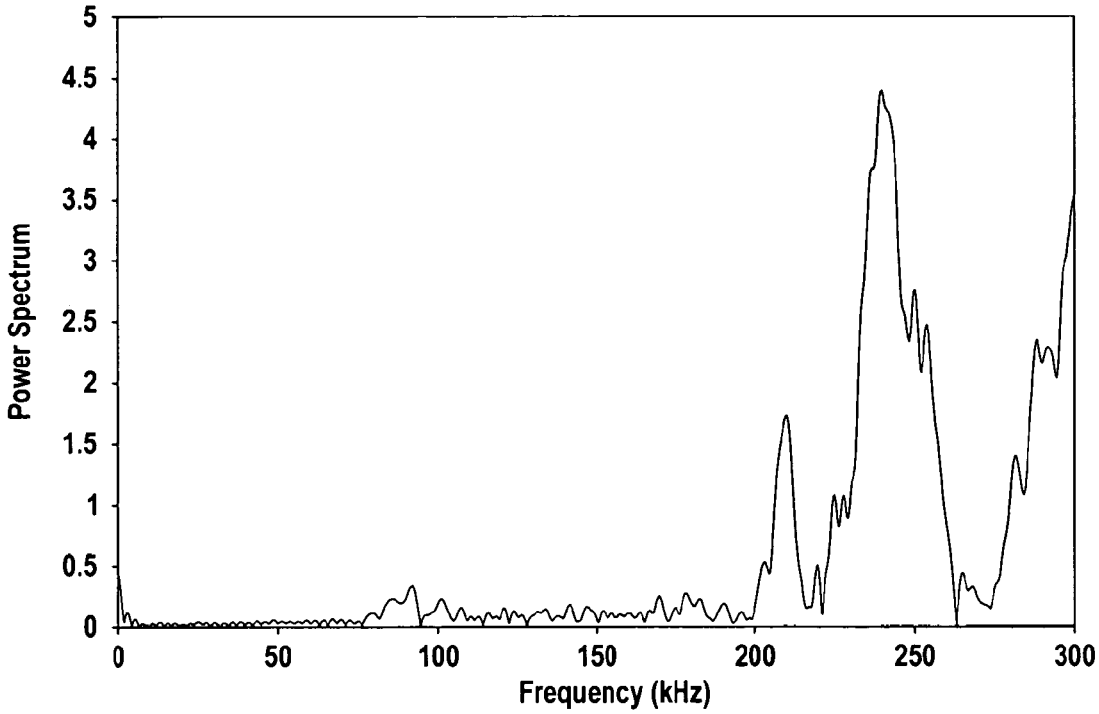
FIG. 6 shows a measured transmission power spectrum for an array of air cylinders in a polymer matrix.

FIG. 6 presents the compounded power spectrum measured on the sample of binary composite materials constituted of a square array of 36 (6×6) parallel cylinders of air embedded in a silicone rubber matrix (see above).

The transmission spectrum in FIG. 6 exhibits a well defined drop in transmitted intensity from above 1 kHz to 200 kHz. This region of the spectrum can be decomposed into an interval of frequencies (1-80 kHz) where only noise level intensity is measured, followed by some transmitted intensity between 80 kHz to 200 kHz. In comparison to results obtained by FDTD simulation (FIG. 5) the experimental band gap is narrower than that calculated. This suggests that inelastic effects may be playing a role. This is addressed further below.

Despite some noise-like transmission, FIG. 6 shows extremely low transmission in the audible range, more specifically, from above 1-2 kHz to more than 75 kHz. This material and other rubber-like materials can thus be very good candidates for sound insulation.

b. Band Structure

Figure 7:
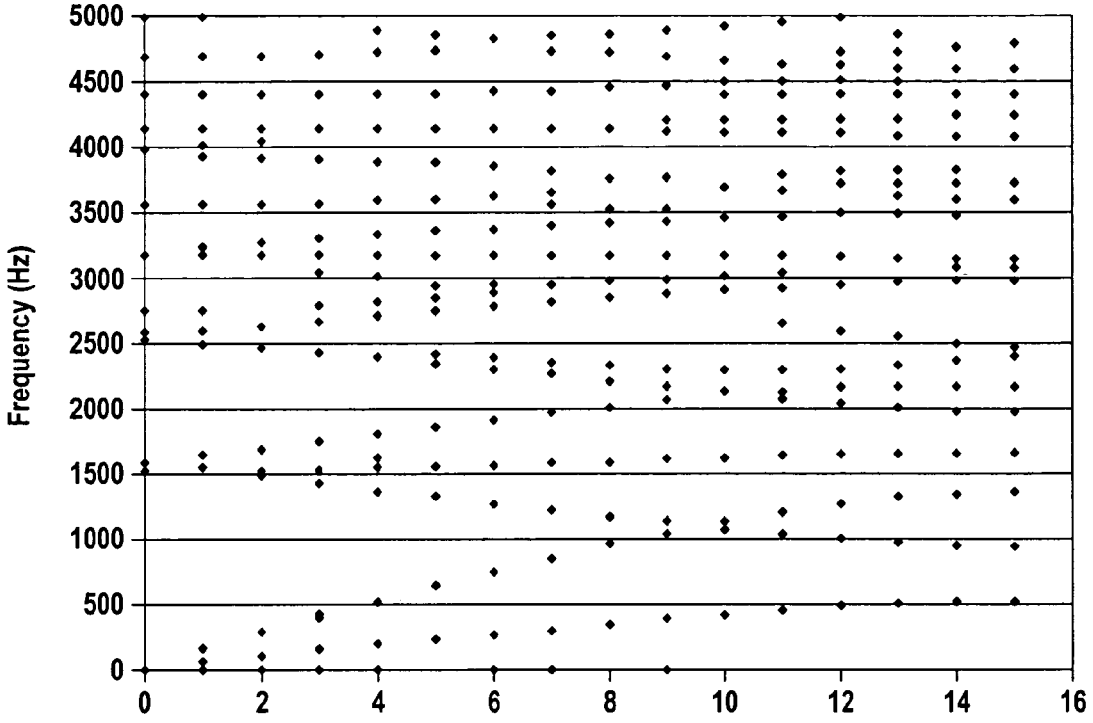
FIG. 7 shows the band structure, calculated using a finite difference time domain (FDTD) method, in a two-dimensional square lattice consisting of air cylinders embedded in a polymer matrix with filling fraction f=0.349. The wave-vector direction is perpendicular to the cylinder axis.

To shed more light on the FDTD and experimental spectra, the band structure of the silicone rubber-air inclusion structure is calculated. FIG. 7 illustrates the FDTD calculations of the dispersion relations for the acoustic waves along the ΓX direction of the irreducible part of the first Brillouin zone of the square lattice. The FDTD scheme assumes a grid of N×N=240$^2$ points in a unit cell (square of polymer with a centered air inclusion of circular cross section; filling fraction f=0.349). In FIG. 7, there is no complete gap in the frequency range plotted in spite of the large acoustic mismatch between the constituent materials (polymer-air). A remarkable feature of the dispersion relation in this lattice is the appearance of a number of optical-like flat branches. The existence of these branches is another characteristic feature of a composite structure constituted from materials with a large acoustic mismatch. Comparison between the calculated band structure and the transmission coefficient indicates that most of the branches in the band structure correspond to deaf bands (i.e. modes with symmetry that cannot be excited by the longitudinal pulse used for the transmission calculation). These branches match to those found in the transmission spectrum in FIG. 5.

Figure 8A:
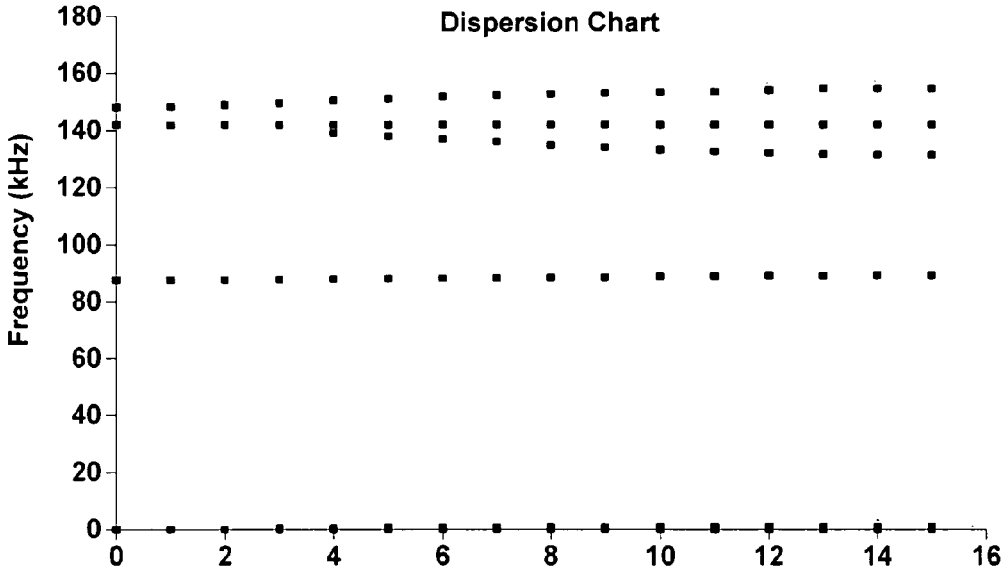
FIG. 8(*a*) is plot of the dispersion relations of the single mode (only longitudinal acoustic waves) in a two-dimensional square lattice consisting of air cylinders embedded in a polymer matrix with filling fraction f=0.349. The wave-vector direction is perpendicular to the cylinder axis.
Figure 8B:
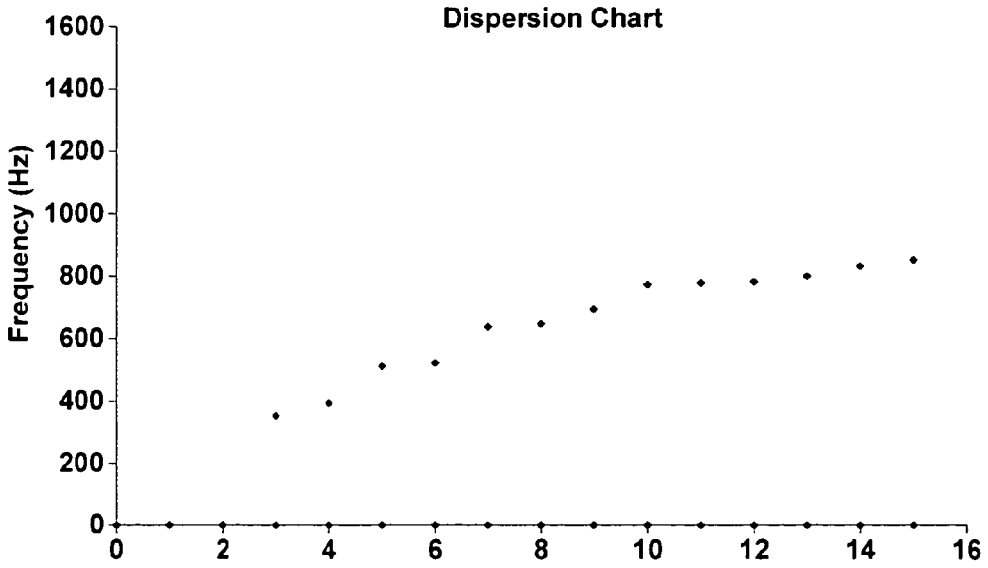

The existence of the deaf bands is confirmed by the calculation of a second band structure for which the transverse wave speed of the polymer is supposed to equal to zero. That is, the rubber/air system is approximated by a fluid-like/fluid composite. The dispersion relations calculated by the FDTD method (with a grid of N×N=240$^2$ points in a unit cell) are shown in FIGS. 8 (*a*) and (*b*). The number of bands decreases drastically. This band structure represents only the longitudinal modes of the structure. Therefore, one can unambiguously assign the branches of FIG. 7 that are not present in FIG. 8 to the bands resulting from the folding within the Brillouin zone of the transverse modes of the rubber. The very low transverse speed of sound in the rubber (20 m/s) leads to a very high density of transverse branches.

FIG. 8 (*a*) shows two large gaps, the first gap from 1 kHz to 89 kHz and the second one from 90 kHz to 132 kHz. FIG. 8 (*b*) more closely shows the first region of the dispersion relations of FIG. 8 (*a*). One can notice that upper edge of the first passing band is around 900 Hz.

For the sake of clarity the flat bands of the air cylinder have been removed from FIGS. 8 (*a*) and (*b*). The frequencies obtained by FDTD band calculations for the first five flat bands are listed in Table 1. These frequencies match with the zeros of the first derivative of the Bessel function of the first kind, $J'_m(\omega r/c)=0$ where c is the speed of sound in air, r is the radius of the air cylinder and m is the order of the Bessel function.

It is therefore clear that the passing bands in the transmission spectrum of FIGS. 5 (*a*) and (*b*) correspond to the excitation of the longitudinal modes of the silicone rubber/air system.

TABLE I

Eigenfrequencies of a perfect square lattice of air cylinders in silicon rubber with radius r = 4 mm and period a = 12 mm. (m is the order of the Bessel function from which the bands derive.)

| Band | 1 (m = 0) | 2 (m = 1) | 3 (m = 2) | 4 (m = 0) | 5 (m = 3) |
|---|---|---|---|---|---|
| Frequency (kHz) | 0.0-0.75 | 25.0 | 41.3 | 52.0 | 57.0 |

c. Transversal Stimulus

Figure 9:
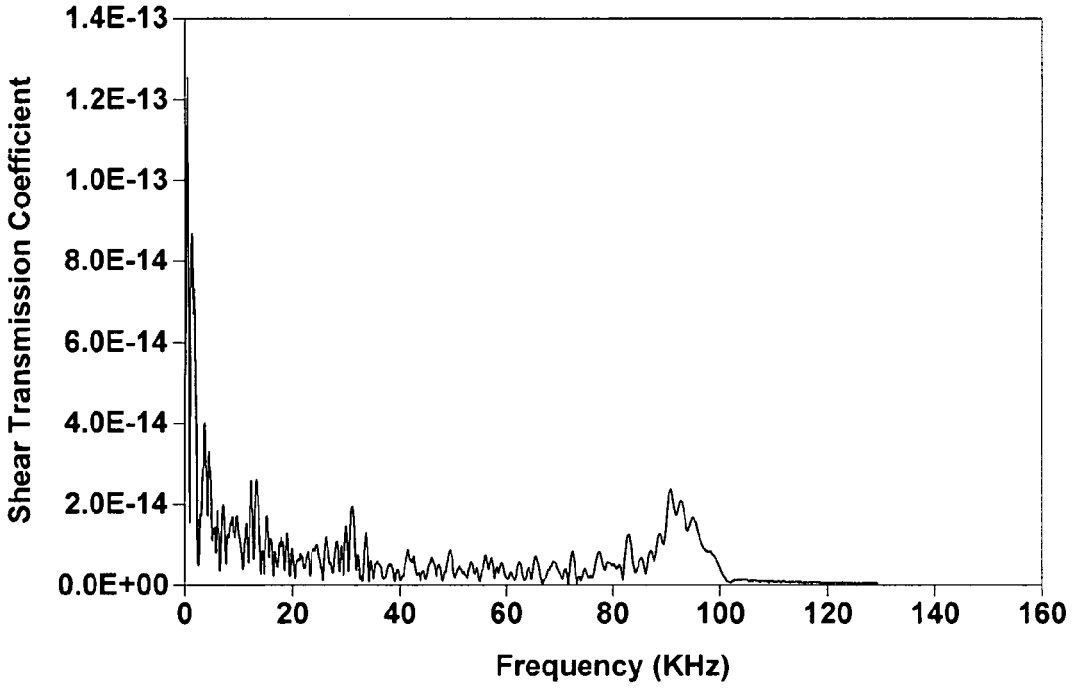
FIG. 9 is a plot of the shear transmission coefficient of the transmitted transversal wave corresponding to a longitudinal stimulus signal.

FIG. 9 shows the power spectrum of the transmitted shear waves corresponding to a compressional stimulus wave packet. This spectrum is the Fourier transform of the time response of the X component (component perpendicular to the direction of propagation of the pulse) of the displacement. FIG. 9 shows that the transverse modes can propagate throughout the rubber/air composite as predicted by the band structure of FIG. 7. However, the very low intensity of the transmitted shear waves demonstrates a nearly negligible conversion rate from compressional to shear waves.

Figure 10:
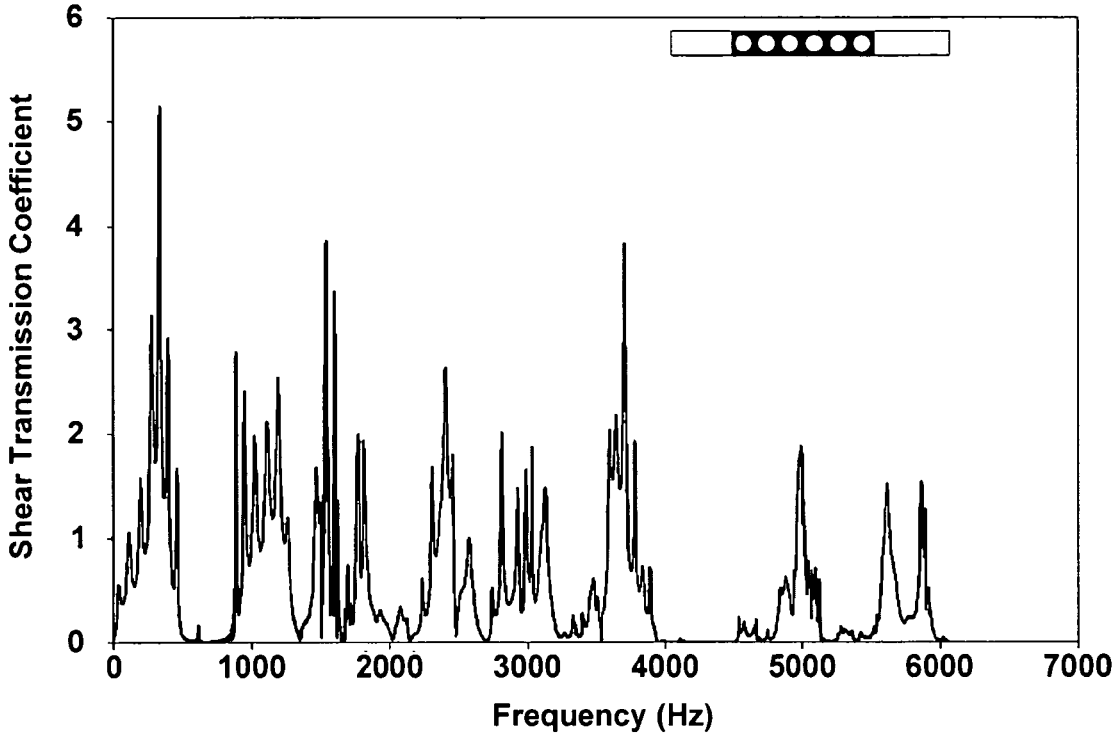
FIG. 10 shows a spectral plot of the transmission coefficient for transverse waves calculated for an array of air cylinders embedded in a polymer matrix.

In a second simulation, the structure is assumed to be stimulated by only acoustic shear waves. The transmission spectrum (FIG. 10) was computed for the transmitted shear waves using the FDTD method for very long time integration ($10\times10^6$ time steps of 7.3 ns) because of the very low transverse speed of sound. Two band gaps can be seen in the transmission spectrum of FIG. 10. The first one is located between 540 to 900 Hz, and the second gap from 4150 to 4600 Hz. These gaps are in excellent agreement with the band structure presented in FIG. 7 if bands corresponding to compressional waves were eliminated.

d. Effect of Transverse Speed

Figure 11:
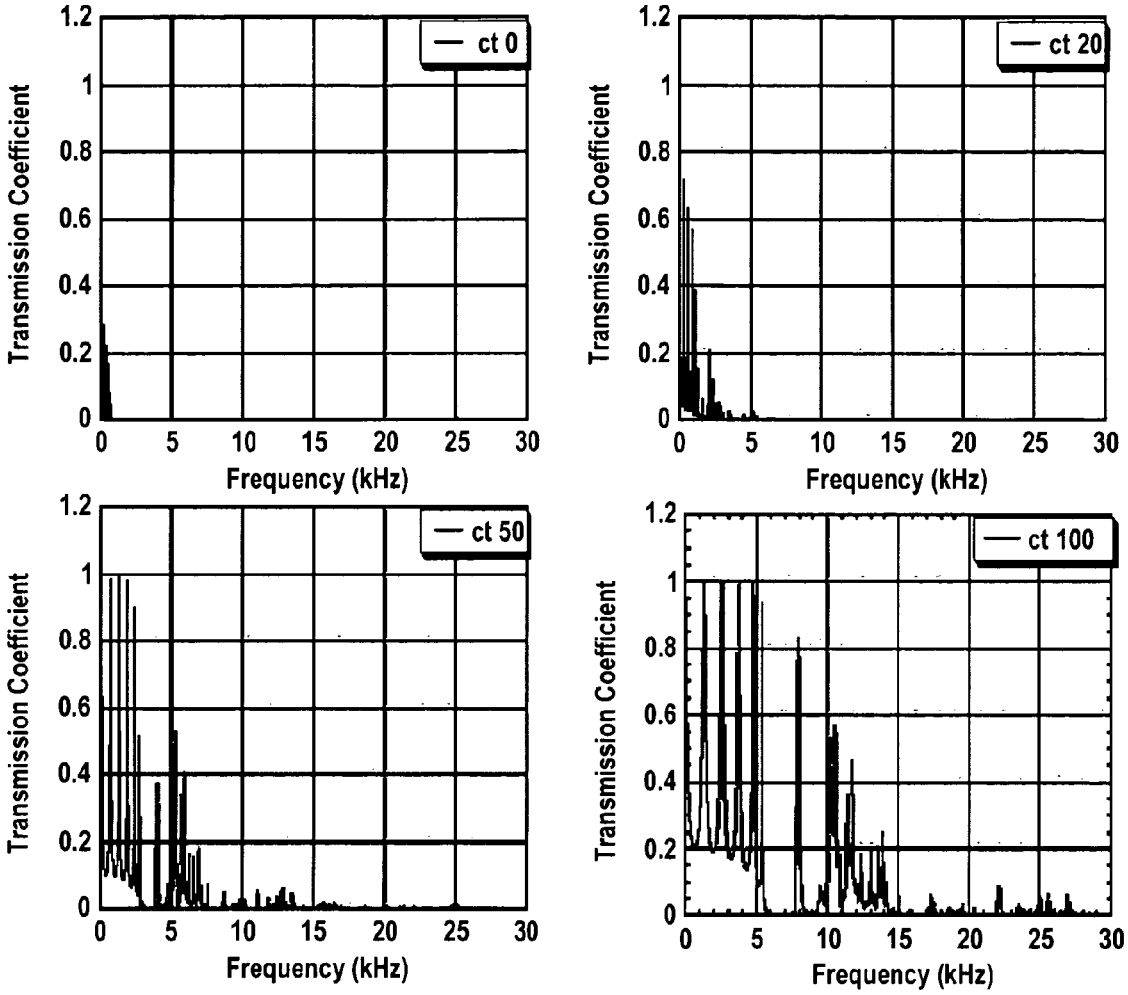
FIG. 11 shows a spectral plot of transmission coefficient for longitudinal waves corresponding to different values of the transverse wave speed for an array of air cylinders embedded in a silicone rubber matrix.

Simulations are carried out with a different value of the transverse wave speed in the silicon-rubber material. FIG. 11 presents the comparison of the transmission coefficient for longitudinal waves corresponding to different values of the transverse wave speed (Ct=0 m/s to Ct=100 m/s) for the silicone rubber-air composite. We notice the appearance of additional bands corresponding to shear waves transmission (for the different transverse speed Ct=20 to 100 m/s) in comparison to those that exist already in the spectrum corresponding to Ct=0 m/s. These bands appear mostly at low frequency under 25 kHz and between 90 kHz and 130 kHz. Note that existing bands in Ct=20 m/s spectrum do not change position when varying the transverse wave speed in the material.

e. Effect of Viscoelasticity i. Single Maxwell Element

In order to further investigate the comparison between the experimental transmission spectrum of longitudinal waves and the simulated system, the effect of viscoelasticity of the properties of the rubber/air system is computed. The same simulation is carried out several times on the 2D array of air cylinders embedded in a viscoelastic silicone rubber matrix. In the following simulations, two variables $\alpha_0$ and the relaxation time $\tau$, that determine the level of viscoelasticity of the rubber are used. The different values for the relaxation time range from $10^{-2}$ s to $10^{-9}$ s and for every value of $\tau$ the simulation is done with different values of $\alpha_0$, (0.75, 0.5, 0.25 and 0.1).

Figure 12A:
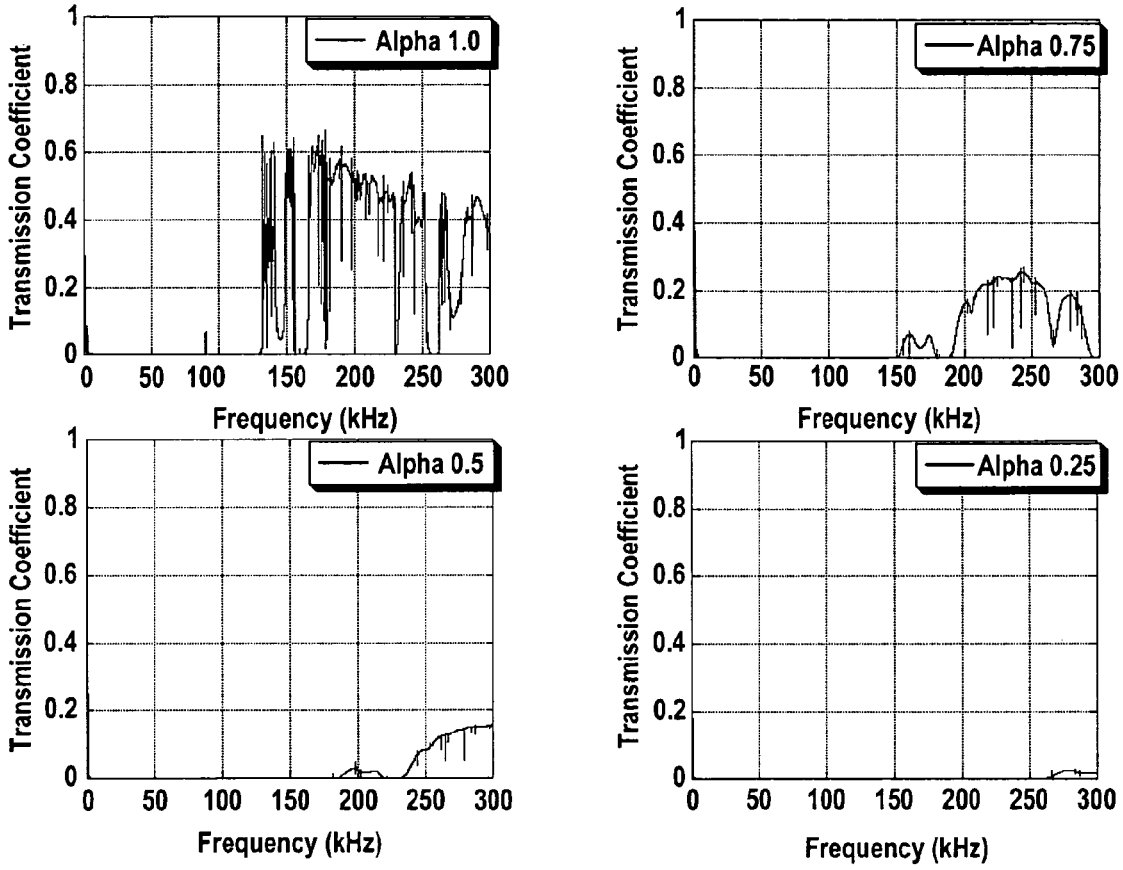
FIG. 12(*a*) shows a spectral plot of the transmission coefficient for longitudinal waves corresponding to different values of $\alpha_0$ for an array of air cylinders embedded in a silicone rubber matrix with relaxation time $\tau=10^{-5}$ s.
Figure 12B:
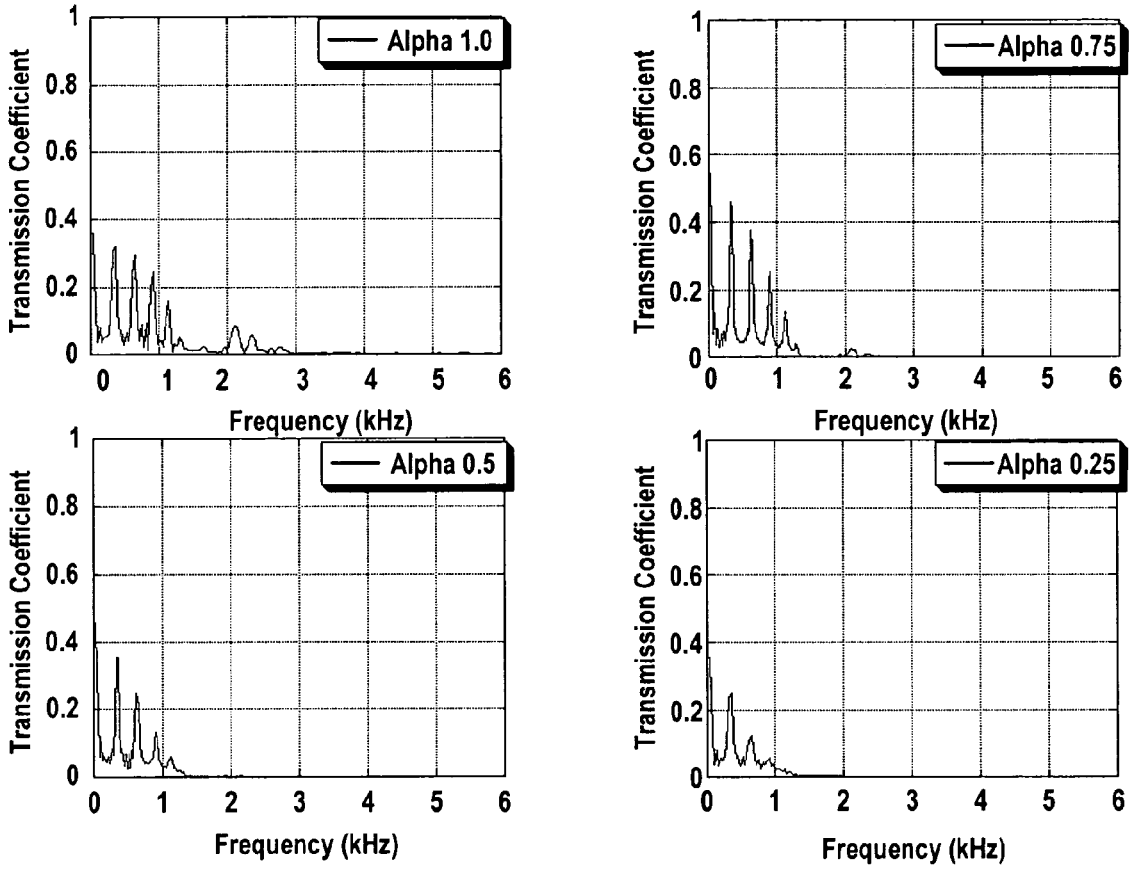

FIG. 12 presents the different transmission spectra corresponding to different values of $\alpha_0$ (0.25; 0.5; 0.75 and finally $\alpha_0$=1 which corresponds to the elastic case) with a relaxation time equal to $10^{-5}$ s.

As the matrix becomes more viscoelastic through a decreasing $\alpha_0$, the high frequency passing bands become more attenuated and shift to higher frequencies.

The upper edge of the lowest passing band (FIG. 12(*b*)) does not appear to be affected much but for a reduction in the level of the transmission coefficient due to loss leading to attenuation of the acoustic wave.

A similar behavior of the transmission spectra for a relaxation time varying from $10^{-2}$ s to $10^{-5}$ s has been observed. When the relaxation time $\tau$ reaches $10^{-6}$ s to $10^{-7}$ s, the high frequency bands (between 150 kHz to 500 kHz) in the transmission spectra are highly attenuated.

Figure 13:
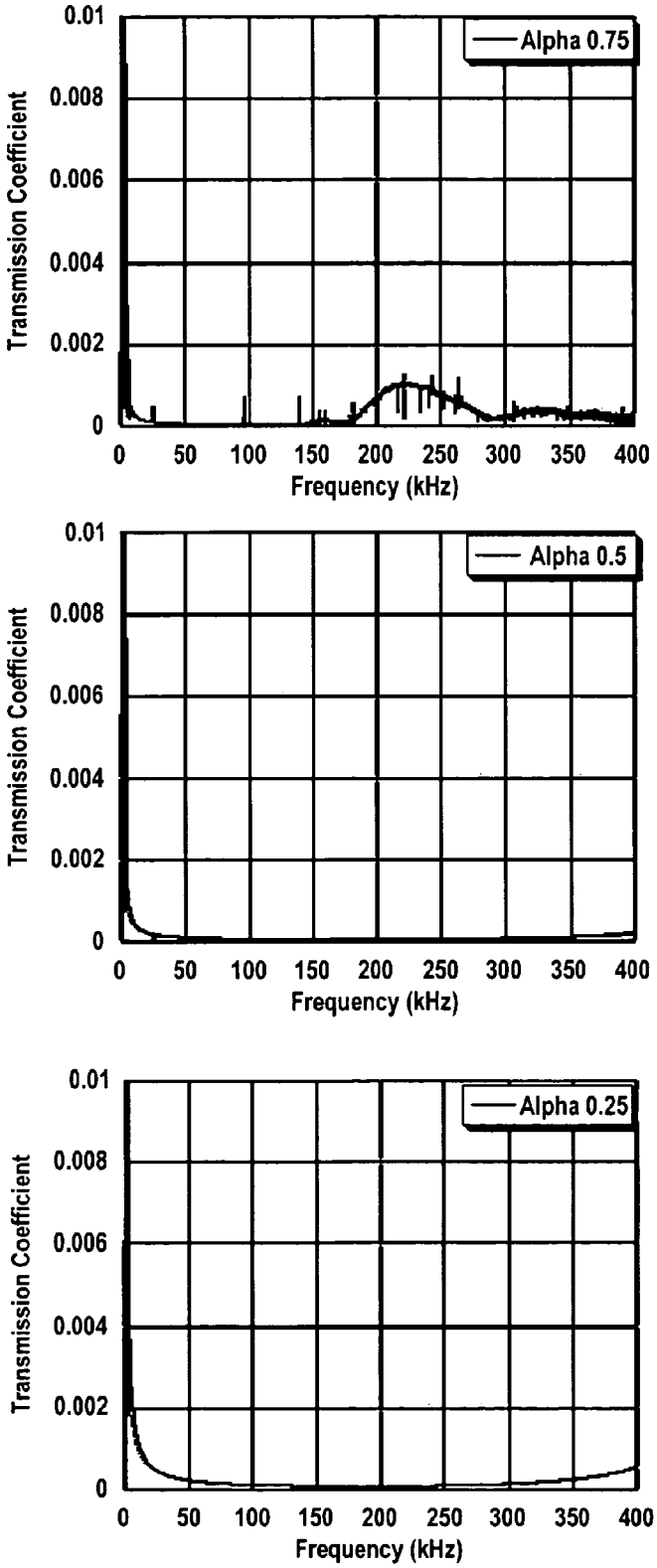
FIG. 13 shows a spectral plot of the transmission coefficient for longitudinal waves corresponding to different values of $\alpha_0$ for an array of air cylinders embedded in a silicone rubber matrix with relaxation time $\tau=10^{-6}$ s.

FIG. 13 presents the different transmission spectra corresponding to different values of $\alpha_0$ for $\tau=10^{-6}$ s. Note that the bands that exist above 150 kHz (in FIG. 12) are highly attenuated in FIG. 13. The first passing band does not appear to be affected with this effect.

Figure 14:
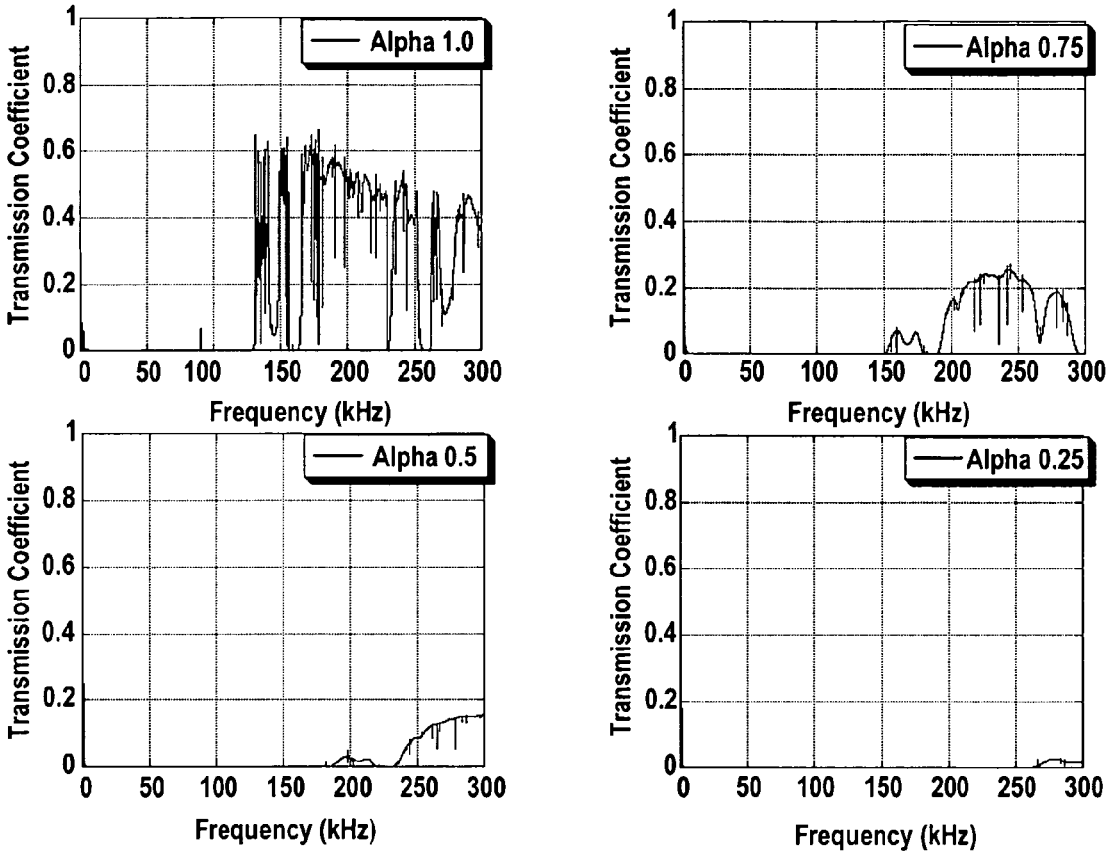
FIG. 14 shows a spectral plot of the transmission coefficient for longitudinal waves corresponding to different values of $\alpha_0$ for an array of air cylinders embedded in a silicone rubber matrix with relaxation time $\tau=10^{-8}$ s.

For very small relaxation time $\tau$ (smaller that $10^{-8}$ s), the transmission spectrum is no more highly attenuated. As the matrix becomes more viscoelastic through a decreasing $\alpha_0$, the passing bands become more attenuated but no longer shift in frequency. FIG. 14 presents the different transmission spectra corresponding to different values of $\alpha_0$ with relaxation time equal to $10^{-8}$ s. Higher attenuation is associated with smaller values of $\alpha_0$ but the bands do not change in position.

Figure 15A:
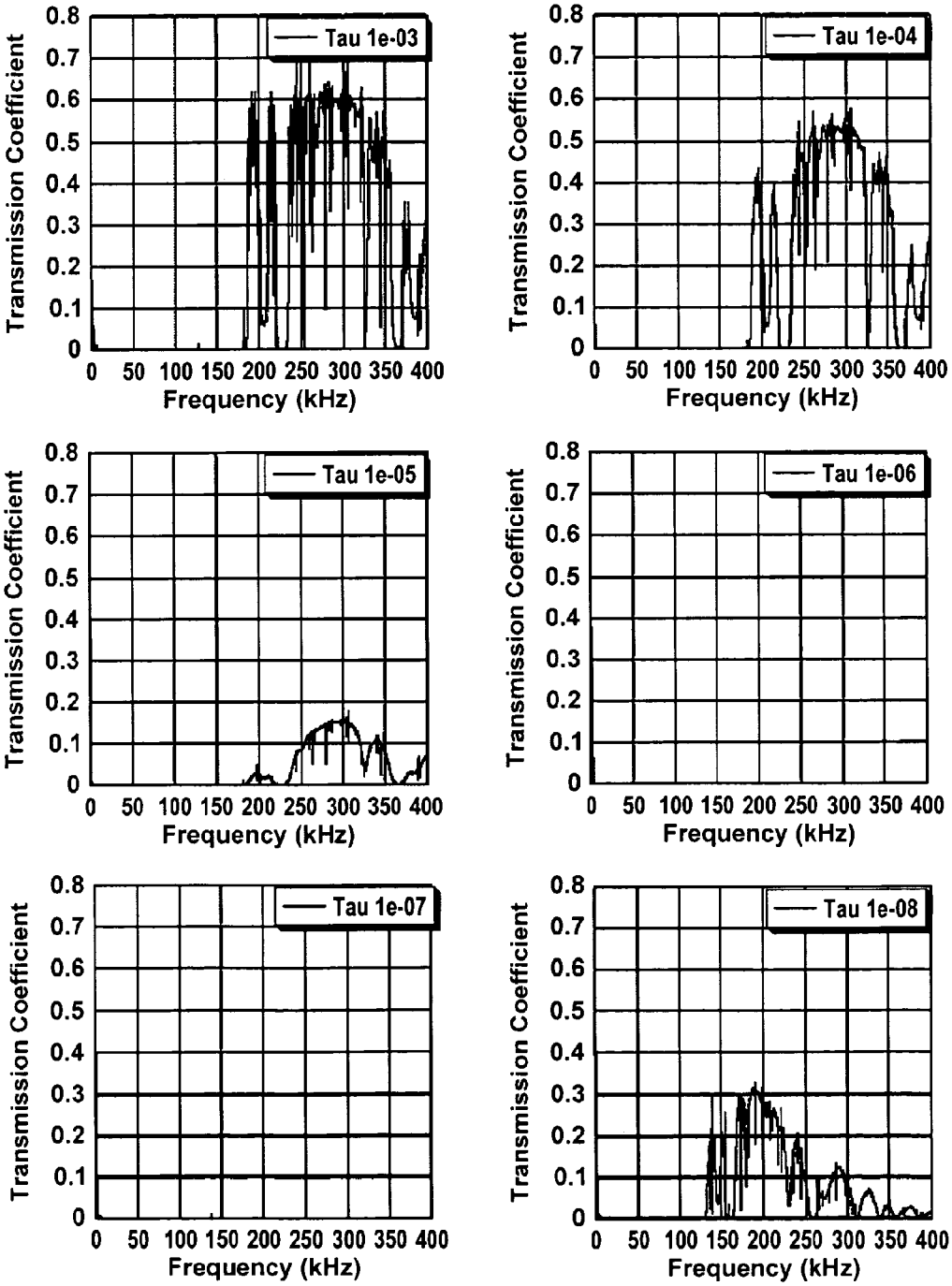
FIG. 15(*a*) shows a spectral plot of the transmission coefficient for longitudinal waves corresponding to different values of relaxation time for an array of air cylinders embedded in a silicone rubber matrix with dimensionless equilibrium tensile modulus of $\alpha_0=0.5$.
Figure 15B:
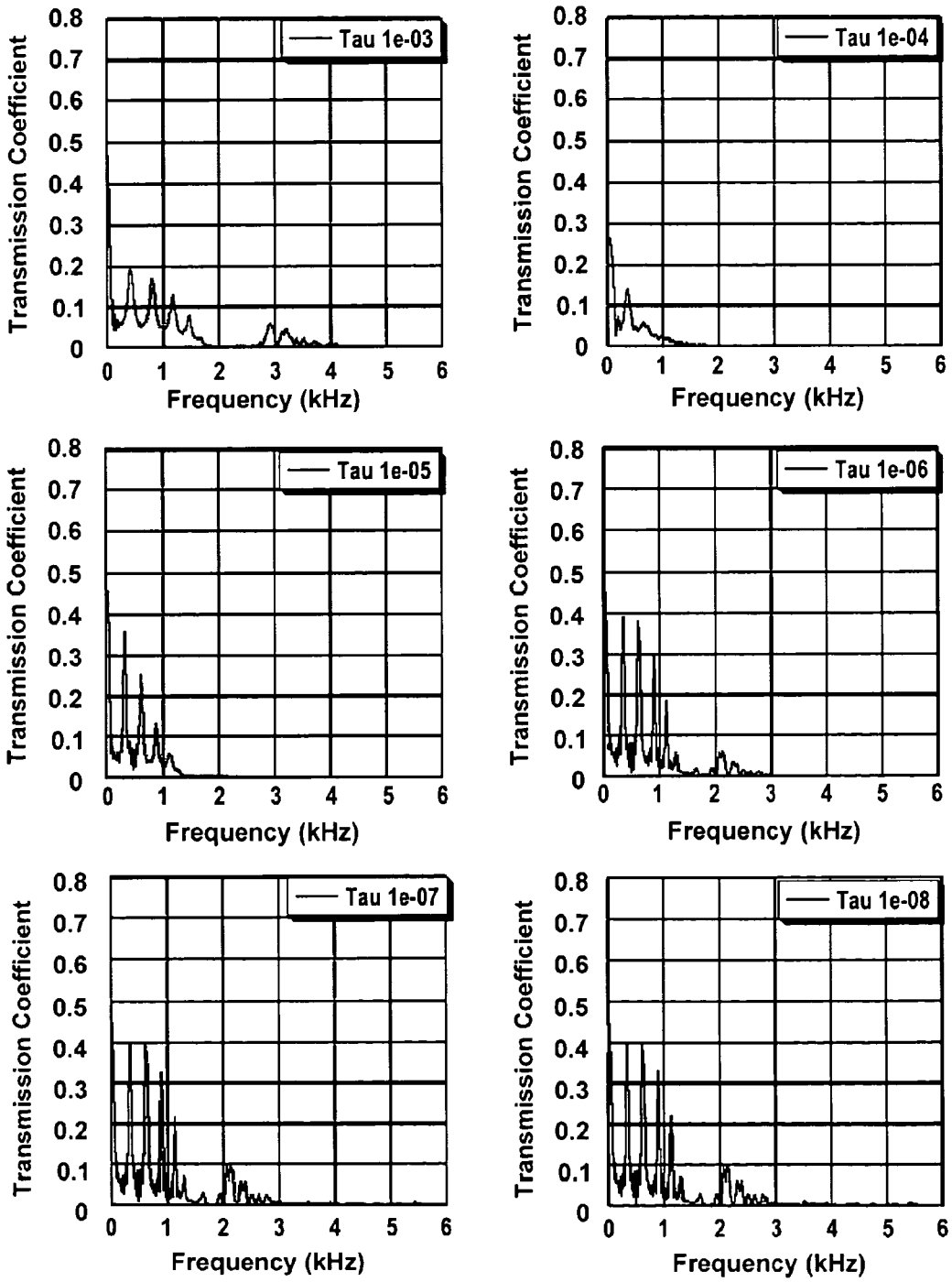

FIGS. 15(*a*) and (*b*) present a comparison of the transmission coefficients corresponding to different values of relaxation time $\tau$ varying from $10^{-2}$ s to $10^{-8}$ s with $\alpha_0$ fixed at 0.5. Note that on FIG. 15(*a*) there is a drop in transmission at frequencies ranging from 150 kHz up to 400 kHz for $\tau$ varying from $10^{-3}$ s to $10^{-6}$ s. The attenuation reaches its maximum in these bands for $\tau=10^{-6}$ s. For lower values of relaxation time ($\tau=10^{-8}$ s) transmission appears again at frequencies starting at 130 kHz and above which corresponds to the beginning of the passing band in the elastic spectrum ($\alpha_0$=1.0).

FIG. 15(*b*) shows a more detailed view of the first region in the transmission spectrum of FIG. 15(*a*). Notice on FIG. 15(*b*) a maximum drop in transmission in the first passing band for $\tau$ ranging from $10^{-3}$ to $10^{-4}$ s. Notice also a shifting in the frequencies when reaching the maximum attenuation around $\tau=10^4$ s.

ii. Generalized Multi-Element Maxwell

In another aspect of the present disclosure, a multi-element Maxwell model is used based on the recursive method described above using the eight (8) elements shown in Table II:

TABLE II

Values of $\alpha_i$ and $\tau_i$ used in the simulation.

| Relaxation Time $\tau$ | $\alpha_i$ |
|---|---|
| | 0.08 |
| $4.32\times10^{-9}$ | 0.36 |
| $5.84\times10^{-8}$ | 0.17 |
| $3.51\times10^{-7}$ | 0.12 |
| $2.28\times10^{-6}$ | 0.10 |
| $1.68\times10^{-5}$ | 0.08 |
| $2.82\times10^{-4}$ | 0.05 |
| $7.96\times10^{-3}$ | 0.03 |
| $9.50\times10^{-3}$ | 0.02 |

Figure 16A:
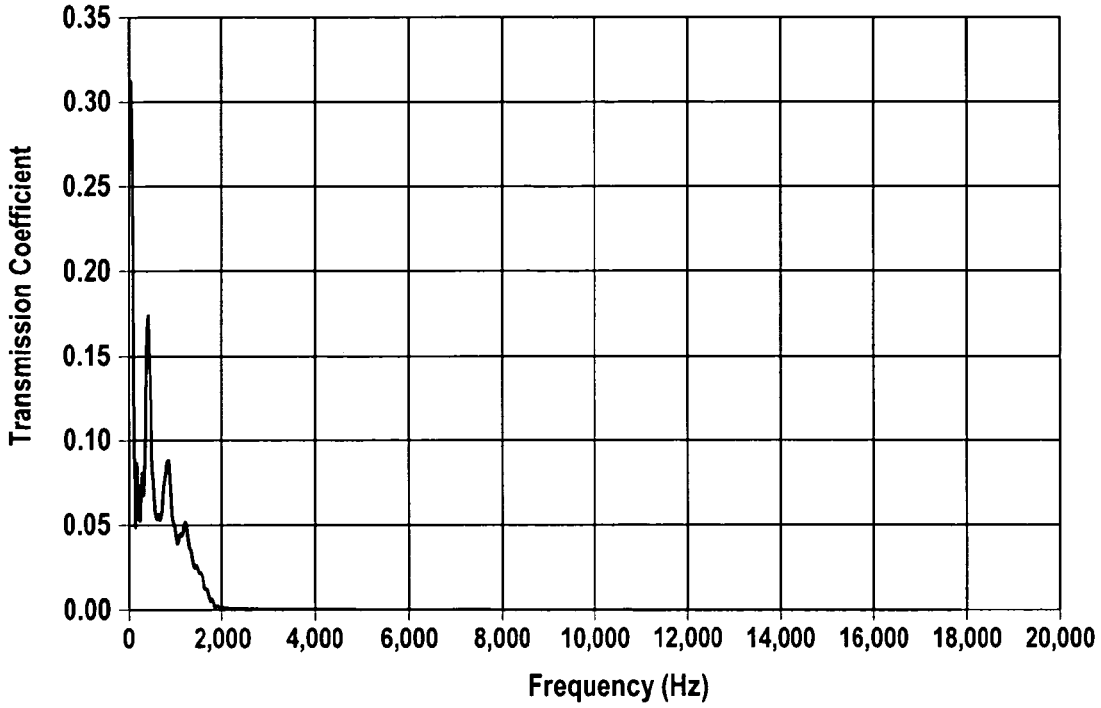
FIG. 16(*a*) shows a spectral plot of the transmission coefficient calculated based on generalized 8-element Maxwell model for longitudinal waves in an array of air cylinders embedded in a silicone rubber matrix.
Figure 16B:
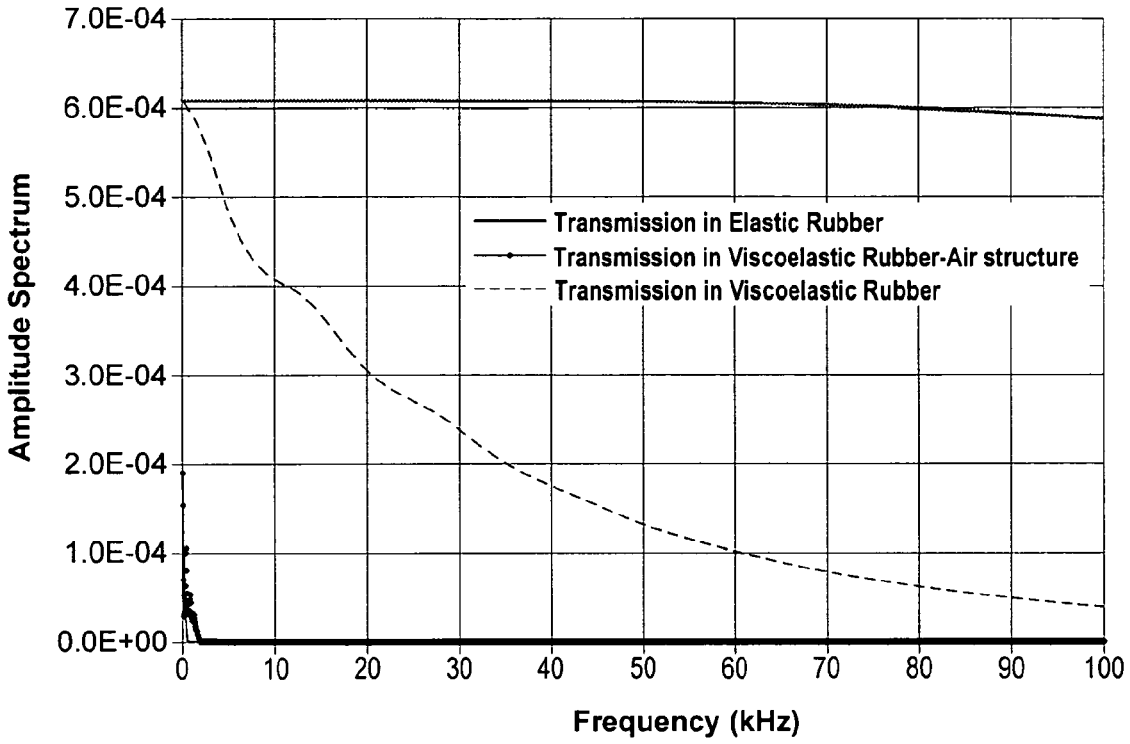
Figure 17:
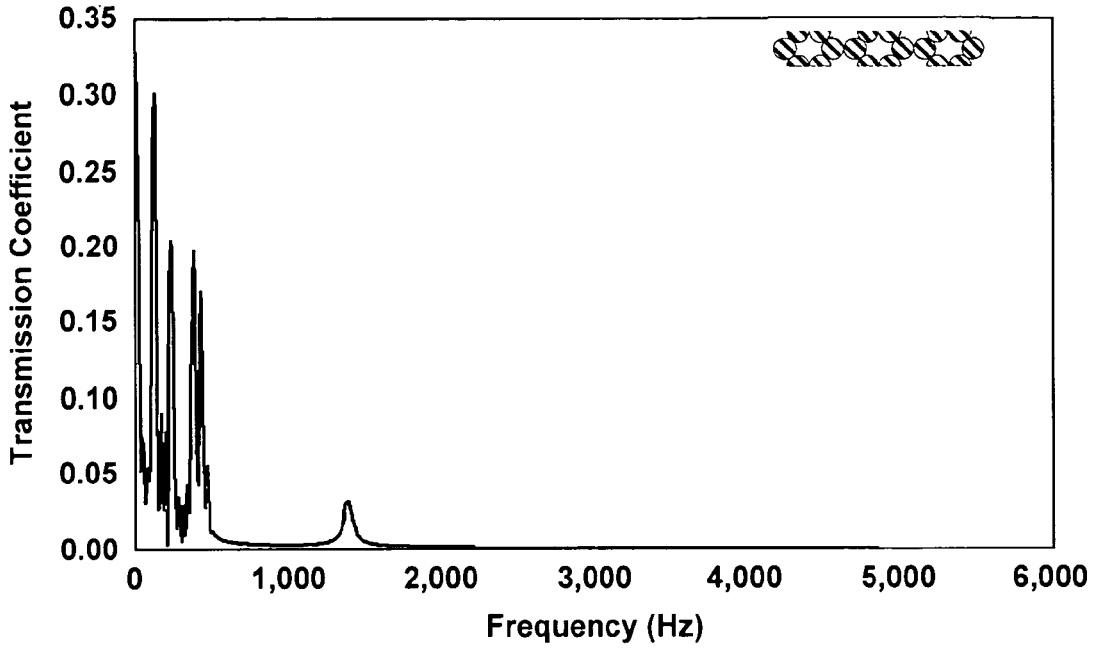
FIG. 17 shows the spectral transmission coefficient for an array of touching polymer cylinders located on a honeycomb lattice in air (cylinder radius 5.75 mm, hexagon lattice parameter 19.9 mm). The overall thickness of the structure normal to the wave propagation direction is 103.5 mm.

FIG. 16(*a*) presents the transmission coefficient for longitudinal waves with a generalized multi-element Maxwell model for the silicone rubber-air composite. We notice that the band gap starts at 2 kHz and there is no other passing band in the high frequency ranges. In addition, the transmission level for the band between 1 kHz and 2 kHz is significantly lowered (less than 8%).

In FIG. 16(*b*), the transmission amplitude spectra in elastic rubber, silicone viscoelastic rubber and the silicone rubber-air composite structures with the same width and elastic properties are compared. Although the silicone viscoelastic rubber structure demonstrates attenuation in the high frequency transmission spectrum, it doesn't present any band gap in the low frequency as the silicone rubber-air composite structure does. This demonstrates the importance of the presence of the periodical array of air-cylinders in the silicone rubber matrix. The transmission coefficient is calculated as the ratio of the spectral power transmitted in the composite to that transmitted in the elastic homogeneous medium composed of the matrix material.

2. Air Matrix/Rubber Inclusions a. Transmission in Air/Rubber Structure

Calculations are carried out for the arrays of polymer cylinders located on a honeycomb lattice embedded in air (See FIG. 4). The transmission coefficient of this structure (shown in FIG. 16) is computed using the FDTD method for very long time integration ($2.5\times10^6$ time steps of 14 ns). Notice a large band gap starting at 1.5 kHz and extending to more than 50 kHz. Another gap exists between 480 Hz and 1300 Hz. The transmission level for the band between 1300 and 1500 Hz is low (3%).

b. Effect of Viscoelasticity

Figure 18:
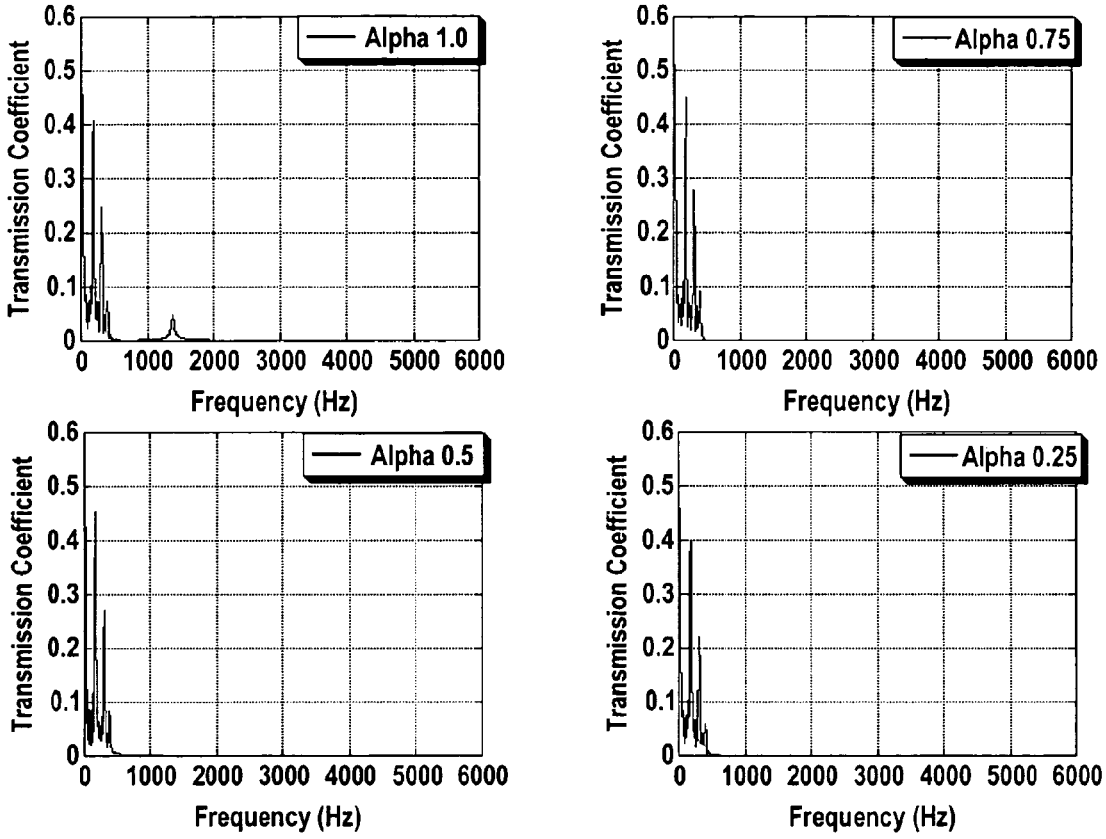
FIG. 18 shows a comparison of different transmission coefficients corresponding to different values of $\alpha_0$ measured for an array of touching polymer cylinders located on a honeycomb lattice in air with a relaxation time equal to $10^4$ s.

The same simulation is carried out several times for the air/rubber structure, the only varying parameter being $\alpha_0$ with a fixed relaxation time equal to $10^{-4}$ s. FIG. 18 presents the different transmission spectra corresponding to different values of $\alpha_0$ (0.25, 0.5; 0.75, and finally $\alpha_0$=1 which corresponds to the elastic case). Notice that the passing band (1.3 kHz to 1.5 kHz for $\alpha_0$, =1) disappears or is highly attenuated as viscoelasticity increases through a decreasing of $\alpha_0$. In addition, no significant changes in the first passing band (less than 480 kHz) is present.

Figure 19:
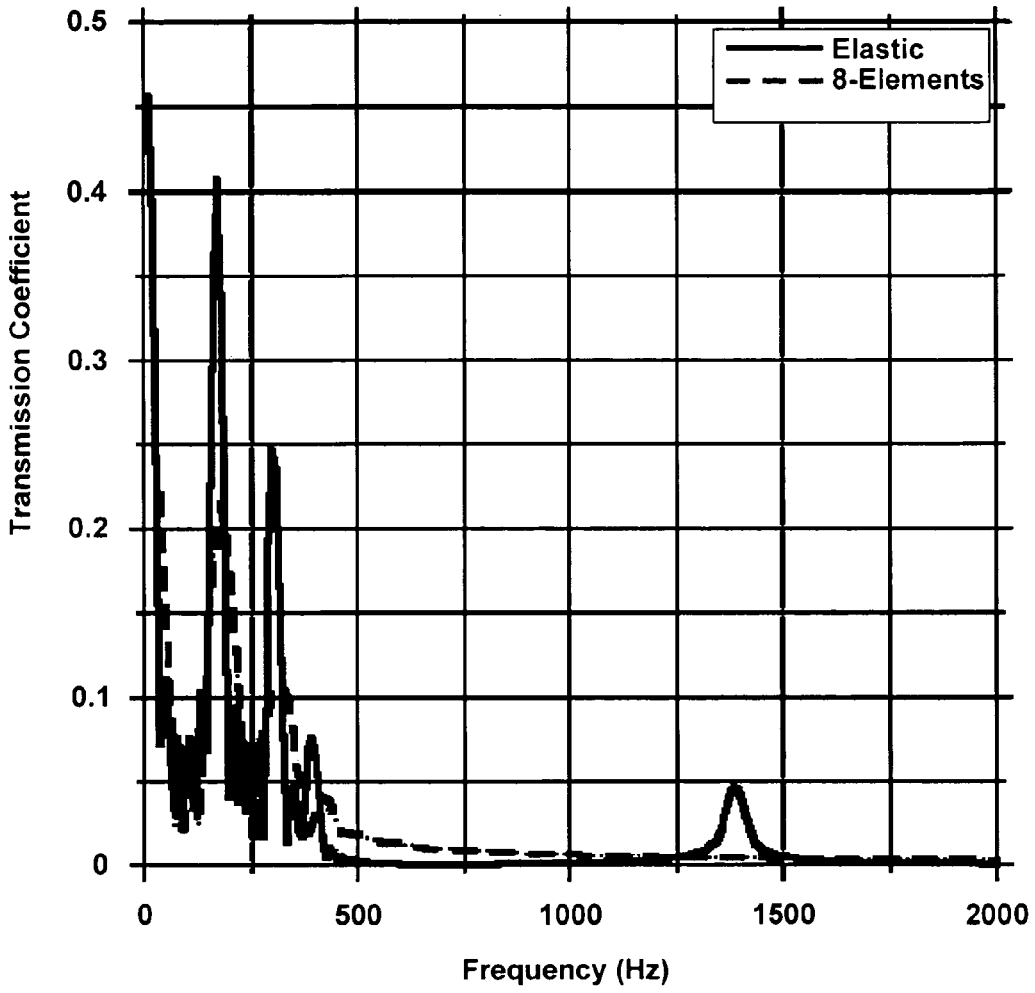
FIG. 19 shows a comparison of the spectral transmission coefficient calculated based on a generalized 8-element Maxwell model versus the elastic model for an array of touching polymer cylinders located on a honeycomb lattice in air (cylinder radius 5.75 mm, hexagon lattice parameter 19.9 mm). The overall thickness of the structure normal to the wave propagation direction is 103.5 mm.

Finally, FIG. 19 presents a comparison of the spectral transmission coefficient based on a generalized 8-element Maxwell model versus the elastic model in the air/rubber structure presented above. Notice a significant drop in the amplitude of the first transmitted band (less <500 kHz). In addition, similarly to the single element derivative method, the passing band (1.3 kHz to 1.5 kHz for $\alpha_0$=1) disappears.

3. Applications

As an example application of certain aspects of the present disclosure, a sound barrier can be constructed, which comprises: (a) a first medium having a first density and (2) a substantially periodic array of structures disposed in the first medium, the structures being made of a second medium having a second density different from the first density. At least one of the first and second media is a solid medium having a speed of propagation of longitudinal sound wave and a speed of propagation of transverse sound wave, the speed of propagation of longitudinal sound wave being at least about 30 times the speed of propagation of transverse sound wave, preferably at least in the audible range of acoustic frequencies.

As another example, a sound barrier can be constructed, which comprises: (a) a first medium comprising a viscoelastic material; and (2) a second medium (such as air) having a density smaller than the first medium, configured in a substantially periodic array of structures and embedded in the first medium.

As a further example, a method of making a sound barrier can be devised, which comprises: (a) selecting a first candidate medium comprising a viscoelastic material having a speed of propagation of longitudinal sound wave, a speed of propagation of transverse sound wave, a plurality of relaxation time constants; (2) selecting a second candidate medium; (3) based at least in part on the plurality of relaxation time constants, determining an acoustic transmission property of a sound barrier comprising a substantially periodic array one of the first and second candidate media embedded in the other one of the first and second candidate media; and (4) determining whether the first and second media are to be used to construct a sound barrier based at least in part on the result of determining the acoustic transmission property.

As a further example, a method of sound insulation comprises blocking at least 99.0% of acoustic power in frequencies ranging from about 4 kHz or lower through about 20 kHz or higher using a sound barrier of not more than about 300 mm thick and constructed as described above.

III. Summary

Reasonably small structures that exhibit a very large stop band in the audible range (e.g. from nearly 500 Hz to above 15 kHz) can be constructed by using viscoelastic materials such as rubber. These structures do not necessarily exhibit absolute band gaps. However, since the transverse speed of sound in rubber can be nearly two orders of magnitude lower than that of longitudinal waves, leading to an effective decoupling of the longitudinal and transverse modes, these solid/fluid composites behave essentially like a fluid/fluid system for the transmission of longitudinal waves.

Materials properties, including viscoelasticity coefficients $\alpha_0$ and $\tau$, which can be frequency-dependent, have an important effect in shifting or highly attenuating the passing bands in viscoelastic polymer-fluid composites. These materials properties can therefore be used in designing sound barriers with desired acoustic properties.

The above specification, examples and data provide a complete description of the viscoelastic phononic crystal of the invention and the make and use thereof. Since many embodiments of the invention can be made without departing from the spirit and scope of the invention, the invention resides in the claims hereinafter appended.

APPENDIX

Computer Modeling in Process of Designing Viscoelastic Phononic Crystal Sound Barriers First, we introduce some notation and relevant assumptions. Let d denote the number of space dimensions, r a point in $\Omega\subset R_d$ and t time. Assume that the bounded domain $\Omega$ is occupied by some body or substance. The following concepts will be used throughout this paper. The displacement, i.e., the change of position at a point (r, t), will be denoted by u=u(r, t)$\subset R_d$. The associated velocity, v=v(r, t), is approximated by $v\approx u^{\bullet}$, where the • denotes differentiation with respect to time. The stress tensor is denoted by $\sigma=\sigma(x, t)$. This tensor is symmetric, $\sigma\subset S_{dxd}$ and contains therefore at most d distinct values. Its interpretation is essentially related to the associated concept stress. The stress ç is a measure of the internal force per area of an object, specified in relation to a plane with normal vector n. This quantity can be calculated using the stress tensor, $\varsigma=\sigma\cdot n$. The strain tensor measures the change of shape of the material and it is denoted by $\epsilon=\epsilon(r, t) \subset R_{dxd}$.

Throughout we assume that the deformation of the substances or objects considered is small. In this case, the strain tensor is defined by:

$$\varepsilon(u) = \frac{1}{2}(gradu + gradu^T) \tag{1}$$

where the superscript $^T$ indicates the transpose.

Observe that, $\epsilon^{\bullet}=\epsilon(u^{\bullet})=\epsilon(v)$. Moreover, as the deformations considered are small, we may define an initial state of the domain $\Omega_0=\Omega$ and consider the former relations on this domain instead of on $\Omega_t$, the domain at any time t. This assumption enables us to operate with a single domain $\Omega$ and boundary $\partial\Omega$.

1. Modeling

The partial differential equations describing the behavior of viscoelastic materials to serve as basis of the FDTD method for acoustic wave propagation in lossy materials is described below.

First we select a constitutive relation that realistically represents the broad class of viscoelastic materials of interest. There are many to choose from, as evidenced by the broad discipline of rheology devoted to this subject. In one aspect of the present disclosure, in the case of linear acoustics, where displacements and strains are small, all (non-linear) constitutive relations is reduce to one, unique, form that obeys the principle of material objectivity. This class of materials are called General Linear Viscoelastic Fluids (GLVF). When the GLVF material also is compressible, the total stress tensor is given by $$\sigma(t) = 2\int_{-\infty}^{t} G(t-t')D(t')dt' + \int_{-\infty}^{t}\left[K(t-t') - \frac{2}{3}G(t-t')\right][\nabla\cdot v(t')]Idt' \tag{2}$$

where t is time, v(t) is the velocity vector, D(x, t) is the rate of deformation tensor given by $$D = \frac{1}{2}[(\nabla v) + (\nabla v)^T] \tag{3}$$

and G(t) and K(t) are the steady shear and bulk moduli, respectively. These moduli can be experimentally determined through rheometry and the data can be fit in a variety of ways, including the use of mechanical-analog models such as spring-dashpots (illustrated below) to achieve the fits.

A viscoelastic model, or in effect, the behavior pattern it describes, may be illustrated schematically by combinations of springs and dashpots, representing elastic and viscous factors, respectively. Hence, a spring is assumed to reflect the properties of an elastic deformation, and similarly a dashpot to depict the characteristics of viscous flow. Clearly, the simplest manner in which to schematically construct a viscoelastic model is to combine one of each component either in series or in parallel. These combinations result in the two basic models of viscoelasticity, the Maxwell and the Kelvin-Voigt models. Their schematic representations are displayed in FIG. 1.

Figure 2:
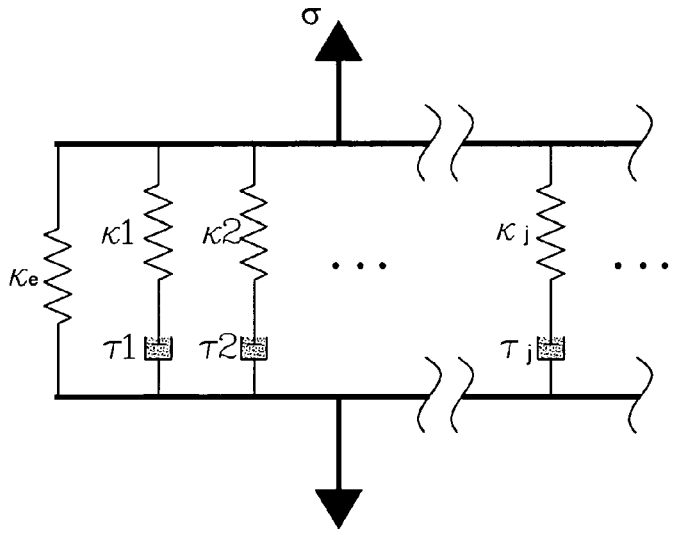
FIG. 2 is an illustration of the Maxwell-Weichert model.

The Generalized Maxwell model, also known as the Maxwell-Weichert model, takes into account the fact that the relaxation does not occur with a single time constant, but with a distribution of relaxation times. The Weichert model shows this by having as many spring-dashpot Maxwell elements as are necessary to accurately represent the distribution. See FIG. 2.

For the Generalized Maxwell model:

$$E(t) = E_\infty + \sum_i E_i e^{-\frac{t}{\tau_i}} \tag{4}$$

By defining $$\alpha(t) = \alpha_0 + \sum_{i=1}^{n} \alpha_i e^{-t/\tau_i} \tag{5}$$

where $$\alpha_0 = \frac{E_\infty}{E_{sum}},\ \alpha_i = \frac{E_i}{E_{sum}} \text{ and } \sum_{i=0}^{n}\alpha_i = 1$$

we obtain $$E(t)=E_{sum}\alpha(t) \tag{6}$$

or we have $$E(t)=2G(t)(1+\upsilon)=3K(t)(1-2\upsilon) \tag{7}$$

Then we can write $$G(t)=G_{sum}\alpha(t) \tag{8}$$

and $$K(t)=K_{sum}\alpha(t) \tag{9}$$

with $$G_\infty=\mu \tag{10}$$

and $$K_\infty - \frac{2}{3}G_\infty = \lambda \tag{11}$$

where $\lambda$ and $\mu$ are the Lamé constants and $\nu$ is Poisson's ratio.

In preparation for the FDTD method, develop equations 2 and 3 for a two (d=2) dimension space domain:

$$[D] = \frac{1}{2}\begin{bmatrix} 2\frac{\partial v_x}{\partial x} & \left(\frac{\partial v_x}{\partial y} + \frac{\partial v_y}{\partial x}\right) \\ \left(\frac{\partial v_x}{\partial y} + \frac{\partial v_y}{\partial x}\right) & 2\frac{\partial v_y}{\partial y} \end{bmatrix} \tag{12}$$

Combining equations (8), (9) and (12) into equation (2) we obtain:

$$[\sigma]=\begin{bmatrix} 2\int_{-\infty}^{t} G(t-t')\frac{\partial v_x}{\partial x}(t')dt' & \int_{-\infty}^{t} G(t-t')\left(\frac{\partial v_x}{\partial y}(t')+\frac{\partial v_y}{\partial x}(t')\right)dt' \\ \int_{-\infty}^{t} G(t-t')\left(\frac{\partial v_x}{\partial y}(t')+\frac{\partial v_y}{\partial x}(t')\right)dt' & 2\int_{-\infty}^{t} G(t-t')\frac{\partial v_y}{\partial y}(t')dt' \end{bmatrix}+ \tag{13}$$

$$\begin{bmatrix} \int_{-\infty}^{t}\left(K(t-t')-\frac{2}{3}G(t-t')\right)\left(\frac{\partial v_x}{\partial x}(t')+\frac{\partial v_y}{\partial y}(t')\right)dt' & 0 \\ 0 & \int_{-\infty}^{t}\left(K(t-t')-\frac{2}{3}G(t-t')\right)\left(\frac{\partial v_x}{\partial x}(t')+\frac{\partial v_y}{\partial y}(t')\right)dt' \end{bmatrix}$$

This equation can be written in the following three basic equations:

$$\sigma_{xx}(t)=2\int_{-\infty}^{t} G(t-t')\frac{\partial v_x}{\partial x}(t')dt'+\int_{-\infty}^{t}\left(K(t-t')-\frac{2}{3}G(t-t')\right)\left(\frac{\partial v_x}{\partial x}(t')+\frac{\partial v_y}{\partial y}(t')\right)dt' \tag{14}$$

$$\sigma_{yy}(t)=2\int_{-\infty}^{t} G(t-t')\frac{\partial v_y}{\partial y}(t')dt'+\int_{-\infty}^{t}\left(K(t-t')-\frac{2}{3}G(t-t')\right)\left(\frac{\partial v_x}{\partial x}(t')+\frac{\partial v_y}{\partial y}(t')\right)dt' \tag{15}$$

$$\sigma_{xy}(t)=\sigma_{yx}(t)=\int_{-\infty}^{t} G(t-t')\left(\frac{\partial v_x}{\partial y}(t')+\frac{\partial v_y}{\partial x}(t')\right)dt' \tag{16}$$

a. Single Element Maxwell Model

In the case of one Maxwell element equations (8) and (9) reduce to:

$$G(t)=\frac{\mu}{\alpha_0}(\alpha_0+\alpha_1 e^{-t/\tau}) \tag{17}$$

$$K(t)-\frac{2}{3}G(t)=\frac{\lambda}{\alpha_0}(\alpha_0+a_1 e^{-t/\tau}) \tag{18}$$

Now develop equation (14):

$$\sigma_{xx}(t)=2\int_{-\infty}^{t}\frac{\mu}{\alpha_0}\left(\alpha_0+\alpha_1 e^{-(t-t')/\tau}\right)\frac{\partial v_x}{\partial x}(t')dt'+\int_{-\infty}^{t}\frac{\lambda}{\alpha_0}\left(\alpha_0+\alpha_1 e^{-(t-t')/\tau}\right)\left(\frac{\partial v_x}{\partial x}(t')+\frac{\partial v_y}{\partial y}(t')\right)dt' \tag{19}$$

$$\sigma_{xx}(t)=(2\mu+\lambda)\int_{-\infty}^{t}\frac{\partial v_x}{\partial x}(t')dt'+\lambda\int_{-\infty}^{t}\frac{\partial v_y}{\partial y}(t')dt'+\frac{\alpha_1}{\alpha_0}(2\mu+\lambda)\int_{-\infty}^{t} e^{-(t-t')/\tau}\frac{\partial v_x}{\partial x}(t')dt'+\frac{\alpha_1}{\alpha_0}\lambda\int_{-\infty}^{t} e^{-(t-t')/\tau}\frac{\partial v_y}{\partial y}(t')dt' \tag{20}$$

Since $C_{11}=2\mu+\lambda$, $C_{12}=\lambda$ and $C_{44}=\mu$, equation (20) becomes $$\sigma_{xx}(t)=C_{11}\frac{du_x}{dx}(t)+C_{12}\frac{du_y}{dy}(t)+\frac{\alpha_1}{\alpha_0}C_{11}e^{-t/\tau}\int_{-\infty}^{t} e^{t'/\tau}\frac{\partial v_x}{\partial x}(t')dt'+\frac{\alpha_1}{\alpha_0}C_{12}e^{-t/\tau}\int_{-\infty}^{t} e^{t'/\tau}\frac{\partial v_y}{\partial y}(t')dt' \tag{21}$$

Alternatively, equation (21) can be differentiated with respect to time:

$$\frac{\partial\sigma_{xx}}{\partial t}(t)=C_{11}\frac{\partial v_x}{\partial x}(t)+C_{12}\frac{\partial v_y}{\partial y}(t)+\frac{\alpha_1}{\alpha_0}C_{11}\frac{\partial}{\partial t}\left[e^{-t/\tau}\int_{-\infty}^{t} e^{t'/\tau}\frac{\partial v_x}{\partial x}(t')dt'\right]+\frac{\alpha_1}{\alpha_0}C_{12}\frac{\partial}{\partial t}\left[e^{-t/\tau}\int_{-\infty}^{t} e^{t'/\tau}\frac{\partial v_y}{\partial y}(t')dt'\right] \tag{22}$$

$$\frac{\partial\sigma_{xx}}{\partial t}(t)=C_{11}\frac{\partial v_x}{\partial x}(t)+C_{12}\frac{\partial v_y}{\partial y}(t)+\frac{\alpha_1}{\alpha_0}C_{11}\left[\frac{-1}{\tau}\int_{-\infty}^{t} e^{-(t-t')/\tau}\frac{\partial v_x}{\partial x}(t')dt'+e^{-t/\tau}e^{t/\tau}\frac{\partial v_x}{\partial x}(t)\right]+\frac{\alpha_1}{\alpha_0}C_{12}\left[\frac{-1}{\tau}\int_{-\infty}^{t} e^{-(t-t')/\tau}\frac{\partial v_y}{\partial y}(t')dt'+e^{-t/\tau}e^{t/\tau}\frac{\partial v_y}{\partial y}(t)\right] \tag{23}$$

Incorporating equation (21) into equation (23), we obtain:

$$\frac{\partial\sigma_{xx}}{\partial t}(t)=C_{11}\frac{\partial v_x}{\partial x}(t)+C_{12}\frac{\partial v_y}{\partial y}(t)+\frac{\alpha_1}{\alpha_0}C_{11}\frac{\partial v_x}{\partial x}(t)+\frac{\alpha_1}{\alpha_0}C_{12}\frac{\partial v_y}{\partial y}(t)-\frac{1}{\tau}\left[\sigma_{xx}(t)-C_{11}\frac{\partial u_x}{\partial x}(t)-C_{12}\frac{\partial u_y}{\partial y}(t)\right] \tag{24}$$

$$\text{with}\ \sum_{i=0}^{n=1}\alpha_i=\alpha_0+\alpha_1=1.$$

Finally we obtain:

$$\frac{\partial\sigma_{xx}}{\partial t}(t)=\frac{C_{11}}{\alpha_0}\frac{\partial v_x}{\partial x}(t)+\frac{C_{12}}{\alpha_0}\frac{\partial v_y}{\partial y}(t)-\frac{1}{\tau}\left[\sigma_{xx}(t)-C_{11}\frac{\partial u_x}{\partial x}(t)-C_{12}\frac{\partial u_y}{\partial y}(t)\right] \tag{25}$$

By performing the same calculations for $\sigma_{yy}$ and $\sigma_{xy}$ we obtain:

$$\frac{\partial\sigma_{yy}}{\partial t}(t)=\frac{C_{11}}{\alpha_0}\frac{\partial v_y}{\partial y}(t)+\frac{C_{12}}{\alpha_0}\frac{\partial v_x}{\partial x}(t)-\frac{1}{\tau}\left[\sigma_{yy}(t)-C_{11}\frac{\partial u_y}{\partial y}(t)-C_{12}\frac{\partial u_x}{\partial x}(t)\right] \tag{26}$$

$$\frac{\partial\sigma_{xy}}{\partial t}(t)=\frac{C_{44}}{\alpha_0}\left(\frac{\partial v_x}{\partial y}(t)+\frac{\partial v_y}{\partial x}(t)\right)-\frac{1}{\tau}\left[\sigma_{xy}(t)-C_{44}\left(\frac{\partial u_x}{\partial y}(t)+\frac{\partial u_y}{\partial x}(t)\right)\right] \tag{27}$$

b. Generalized Multi-Element Maxwell Model

For a multi-element Maxwell model equation (14) is written as the following:

$$\sigma_{xx}=2\int_{-\infty}^{t}\frac{\mu}{\alpha_0}\left(\alpha_0+\sum_{1}^{n}\alpha_i e^{-\frac{(t-t')}{\tau_i}}\right)\frac{\partial v_x}{\partial x}(t')dt'+ \tag{28}$$

-continued $$\int_{-\infty}^{t} \frac{\lambda}{\alpha_0}\left(\alpha_0 + \sum_{1}^{n} \alpha_i e^{-\frac{(t-t')}{\tau_i}}\right)\left(\frac{\partial v_x}{\partial x}(t') + \frac{\partial v_y}{\partial y}(t')\right)dt'$$

By developing equation (28), $$\sigma_{xx}(t) = 2\mu\int_{-\infty}^{t} \frac{\partial v_x}{\partial x}(t')dt' + \frac{2\mu+\lambda}{\alpha_0}\int_{-\infty}^{t}\sum_{1}^{n}\alpha_i e^{-\frac{(t-t')}{\tau_i}}\frac{\partial v_x}{\partial x}(t')dt' + \lambda\int_{-\infty}^{t}\frac{\partial v_x}{\partial x}(t')dt' + \lambda\int_{-\infty}^{t}\frac{\partial v_y}{\partial y}(t')dt' + \frac{\lambda}{\alpha_0}\int_{-\infty}^{t}\sum_{1}^{n}\alpha_i e^{-\frac{(t-t')}{\tau_i}}\frac{\partial v_y}{\partial y}(t')dt' \tag{29}$$

This equation can be written as $$\sigma_{xx}(t) = C_{11}\frac{\partial u_x}{\partial x}(t) + C_{12}\frac{\partial u_y}{\partial y}(t) + \frac{C_{11}}{\alpha_0}\int_{-\infty}^{t}\sum_{1}^{n}\alpha_i e^{-\frac{(t-t')}{\tau_i}}\frac{\partial v_x}{\partial x}(t')dt' + \frac{C_{12}}{\alpha_0}\int_{-\infty}^{t}\sum_{1}^{n}\alpha_i e^{-\frac{(t-t')}{\tau_i}}\frac{\partial v_y}{\partial y}(t')dt' \tag{30}$$

where $C_{11}=2\mu+\lambda$, $C_{12}=\lambda$ and $C_{44}=\mu$

By performing some manipulation over the integral and the summation we obtain:

$$\sigma_{xx}(t) = C_{11}\frac{\partial u_x}{\partial x}(t) + C_{12}\frac{\partial u_y}{\partial y}(t) + \frac{C_{11}}{\alpha_0}\sum_{1}^{n}\alpha_i\int_{-\infty}^{t} e^{-\frac{(t-t')}{\tau_i}}\frac{\partial v_x}{\partial x}(t')dt' + \frac{C_{12}}{\alpha_0}\sum_{1}^{n}\alpha_i\int_{-\infty}^{t} e^{-\frac{(t-t')}{\tau_i}}\frac{\partial v_y}{\partial y}(t')dt' \tag{31}$$

To calculate the following integral to arrive at $Ix_i(t)$ $$\int_{-\infty}^{t}\frac{\partial v_x(t')}{\partial x}e^{\frac{(t-t')}{\tau_i}}dt' \approx \int_{0}^{t}\frac{\partial v_x(t')}{\partial x}e^{\frac{(t-t')}{\tau_i}}dt' = Ix_i(t) \tag{32}$$

suppose w=t−t', which leads to dw=−dt'. By replacing it in (32) we obtain:

$$Ix_i(t) = \int_{0}^{t}\frac{\partial v_x(t-w)}{\partial x}e^{\frac{w}{\tau_i}}dw \tag{33}$$

Now, calculate $Ix_i(t+dt)$.

$$Ix_i(t+dt) = \int_{0}^{t+dt}\frac{\partial v_x(t+dt-w)}{\partial x}e^{\frac{w}{\tau_i}}dw \tag{34}$$

-continued $$Ix_i(t+dt) = \int_{0}^{dt}\frac{\partial v_x(t+dt-w)}{\partial x}e^{\frac{w}{\tau_i}}dw + \int_{dt}^{t+dt}\frac{\partial v_x(t+dt-w)}{\partial x}e^{\frac{w}{\tau_i}}dw \tag{35}$$

By changing s=w−dt=>ds=dw, $$Ix_i(t+dt) = \int_{-dt}^{0}\frac{\partial v_x(t-s)}{\partial x}e^{\frac{(s+dt)}{\tau_i}}ds + \int_{0}^{t}\frac{\partial v_x(t-s)}{\partial x}e^{\frac{(s+dt)}{\tau_i}}ds \tag{36}$$

$$Ix_i(t+dt) = \left[\frac{\frac{\partial v_x(t)}{\partial x}e^{-\frac{dt}{\tau_i}} + \frac{\partial v_x(t+dt)}{\partial x}}{2}dt\right] + e^{-\frac{dt}{\tau_i}}\int_{0}^{t}\frac{\partial v_x(t-s)}{\partial x}e^{\frac{s}{\tau_i}}ds \tag{37}$$

Finally, we obtain a recursive form for the integral calculation:

$$Ix_i(t+dt) = \left[\frac{\frac{\partial v_x(t)}{\partial x}e^{\frac{dt}{\tau_i}} + \frac{\partial v_x(t+dt)}{\partial x}}{2}dt\right] + e^{-\frac{dt}{\tau_i}}Ix_i(t) \tag{38}$$

where $Ix_i(0)=0$

Similar equations are obtained for the yy and xy components.

2. FDTD Band Structures

Acoustic band structure of composites materials can be computed using FDTD methods. This method can be used in structures for which the conventional Plane Wave Expansion (PWE) method is not applicable. See, Tanaka, Yukihiro, Yoshinobu Tomoyasu and Shinichiro Tamura. "Band structure of acoustic waves in phononic lattices: Two-dimensional composites with large acoustic mismatch." *PHYSICAL REVIEW B* (2000): 7387-7392. Owing to the periodicity within the XOY plane, the lattice displacement, velocity and the stress tensor take the forms satisfying the Bloch theorem:

$$u_i(r,t)=e^{ik.r}U_i(r,t) \tag{39}$$

$$v_i(r,t)=e^{ik.r}V_i(r,t) \tag{40}$$

$$\sigma_{ij}(r,t)=e^{ik.r}S_{ij}(r,t) \tag{41}$$

where $k=(k_x, k_y)$ is a Block wave vector and U(r, t), V(r, t) and $S_{ij}(r, t)$ are periodic functions satisfying U(r+a, t)=U(r, t) and $S_{ij}(r+a, t)=S_{ij}(r, t)$ with "a" a lattice translation vector. Thus equations (25), (26) and (27) are rewritten as:

$$\frac{\partial S_{xx}}{\partial t}(t) = ik_x\frac{C_{11}}{\alpha_0}\frac{\partial V_x}{\partial x}(t) + ik_y\frac{C_{12}}{\alpha_0}\frac{\partial V_y}{\partial y}(t) - \frac{1}{\tau}\left[S_{xx}(t) - ik_xC_{11}\frac{\partial U_x}{\partial x}(t) - ik_yC_{12}\frac{\partial U_y}{\partial y}(t)\right] \tag{42}$$

$$\frac{\partial S_{yy}}{\partial t}(t) = ik_y\frac{C_{11}}{\alpha_0}\frac{\partial V_y}{\partial y}(t) + ik_x\frac{C_{12}}{\alpha_0}\frac{\partial V_x}{\partial x}(t) - \frac{1}{\tau}\left[S_{yy}(t) - ik_yC_{11}\frac{\partial U_y}{\partial y}(t) - ik_xC_{12}\frac{\partial U_x}{\partial x}(t)\right] \tag{43}$$

$$\frac{\partial S_{xy}}{\partial t}(t) = \frac{C_{44}}{\alpha_0}\left(ik_y\frac{\partial V_x}{\partial y}(t) + ik_x\frac{\partial V_y}{\partial x}(t)\right) - \frac{1}{\tau}\left[S_{xy}(t) - C_{44}\left(ik_x\frac{\partial U_y}{\partial x}(t) + ik_y\frac{\partial U_x}{\partial y}(t)\right)\right] \tag{44}$$

3. Finite Difference Methods

In one aspect of the present disclosure, the FDTD method is used with a single Maxwell element, which involves transforming the governing differential equations (equations (25), (26) and (27)) in the time domain into finite differences and solving them as one progresses in time in small increments. These equations comprise the basis for the implementation of the FDTD in 2D viscoelastic systems. For the implementation of the FDTD method we divide the computational domain in $N_x \times N_y$ sub domains (grids) with dimension dx, dy.

The derivatives in both space and time can be approximated with finite differences. For space derivatives central differences can be used, where the y direction is staggered to the x direction. For the time derivative, forward difference can be used.

For equation (25), using expansion at point (i, j) and time (n), we obtain:

$$\frac{\sigma_{xx}^{n+1}(i,j)-\sigma_{xx}^{n}(i,j)}{dt}=\frac{C_{11}\left(i+\frac{1}{2},j\right)}{\alpha_0\left(i+\frac{1}{2},j\right)}\frac{v_x^n(i+1,j)-v_x^n(i,j)}{dx}+ \tag{45}$$

-continued $$\frac{C_{12}\left(i+\frac{1}{2},j\right)}{\alpha_0\left(i+\frac{1}{2},j\right)}\frac{v_y^n(i,j)-v_y^n(i,j-1)}{dy}-\frac{1}{\tau(i,j)}\left[\sigma_{xx}^{n+1}(i,j)-C_{11}\left(i+\frac{1}{2},j\right)\frac{u_x^n(i+1,j)-u_x^n(i,j)}{dx}-C_{12}\left(i+\frac{1}{2},j\right)\frac{u_y^n(i,j)-u_y^n(i,j-1)}{dy}\right]$$

where the stress $\sigma_{xx}$ at point (i, j) and at time (n+1) is calculated from the displacement fields $U_x$, $U_y$ and the velocity fields $V_x$, $V_y$ and from the old stress at time (n). When developing equation (45) we obtain:

$$\sigma_{xx}^{n+1}(i,j)=\frac{1}{\left(1+\frac{dt}{\tau(i,j)}\right)}\left[\sigma_{xx}^{n}(i,j)+dt\left(\begin{array}{l}\frac{C_{11}\left(i+\frac{1}{2},j\right)}{\alpha_0\left(i+\frac{1}{2},j\right)}\frac{v_x^n(i+1,j)-v_x^n(i,j)}{dx}+\\ \frac{C_{12}\left(i+\frac{1}{2}j,\right)}{\alpha_0\left(i+\frac{1}{2},j\right)}\frac{v_y^n(i,j)-v_y^n(i,j-1)}{dy}+\\ \frac{1}{\tau(i,j)}C_{11}\left(i+\frac{1}{2},j\right)\frac{u_x^n(i+1,j)-u_x^n(i,j)}{dx}+\\ \frac{1}{\tau(i,j)}C_{12}\left(i+\frac{1}{2},j\right)\frac{u_y^n(i,j)-u_y^n(i,j-1)}{dy}\end{array}\right)\right] \tag{46}$$

where $C_{11}(i+1/2, j)=\sqrt{C_{11}(i+1,j)C_{11}(i,j)}$ and $C_{12}(i+1/2, j)=\sqrt{C_{12}(i+1,j)C_{12}(i,j)}$
and $\alpha_0(i+1/2, j)=\sqrt{\alpha_0(i+1,j)\alpha_0(i,j)}$ For equation (26), expanding at (i, j), $$\sigma_{yy}^{n+1}(i,j)=\frac{1}{\left(1+\frac{dt}{\tau(i,j)}\right)}\left[\sigma_{yy}^{n}(i,j)+dt\left(\begin{array}{l}\frac{C_{11}\left(i+\frac{1}{2},j\right)}{\alpha_0\left(i+\frac{1}{2},j\right)}\frac{v_y^n(i+1,j)-v_y^n(i,j-1)}{dy}+\\ \frac{C_{12}\left(i+\frac{1}{2}j,\right)}{\alpha_0\left(i+\frac{1}{2},j\right)}\frac{v_x^n(i+1,j)-v_x^n(i,j)}{dx}+\\ \frac{1}{\tau(i,j)}C_{11}\left(i+\frac{1}{2},j\right)\frac{u_y^n(i,j)-u_y^n(i,j-1)}{dx}+\\ \frac{1}{\tau(i,j)}C_{12}\left(i+\frac{1}{2},j\right)\frac{u_x^n(i+1,j)-u_x^n(i,j)}{dx}\end{array}\right)\right] \tag{47}$$

For equation (27), expanding at (i, j), $$\sigma_{xy}^{n+1}(i,j) = \frac{1}{\left(1+\frac{dt}{\tau(i,j)}\right)}\left[\sigma_{xy}^{n}(i,j) + dt\frac{C_{44}\left(i,j+\frac{1}{2}\right)}{\alpha_0\left(i,j+\frac{1}{2}\right)}\left(\frac{v_x^n(i,j+1)-v_x^n(i,j)}{dy}+\frac{v_y^n(i,j)-v_y^n(i-1,j)}{dx}\right) + dt\frac{C_{44}\left(i,j+\frac{1}{2}\right)}{\tau(i,j)}\left(\frac{u_x^n(i,j+1)-u_x^n(i,j)}{dy}+\frac{u_y^n(i,j)-u_y^n(i-1,j)}{dx}\right)\right] \quad (48)$$

where $C_{44}(i, j+1/2)=\sqrt{C_{44}(i,j+1)C_{44}(i,j)}$

The above way of discretization of the equations insures second order accurate central difference for the space derivatives. The field components $u_x$ and $u_y$ have to be centered in different space points.

Finally, the velocity fields are calculated according to the elastic wave equation in isotropic inhomogeneous media, $$\frac{\partial v_a}{\partial t} = \frac{1}{\rho}\frac{\partial \sigma_{ab}}{\partial x_b} \quad (49)$$

In 2D space dimensions equation (49) becomes, $$\frac{\partial v_x}{\partial t} = \frac{1}{\rho}\left(\frac{\partial \sigma_{xx}}{\partial x}+\frac{\partial \sigma_{xy}}{\partial y}\right) \quad (50)$$

and $$\frac{\partial v_y}{\partial t} = \frac{1}{\rho}\left(\frac{\partial \sigma_{yy}}{\partial y}+\frac{\partial \sigma_{xy}}{\partial x}\right) \quad (51)$$

For equation (50), using expansion at point (i, j) and time (n), we obtain:

$$\frac{v_x^{n+1}(i,j)-v_x^n(i,j)}{dt} = \frac{1}{\rho(i,j)}\left(\frac{\sigma_{xx}^{n+1}(i,j)-\sigma_{xx}^{n+1}(i-1,j)}{dx}+\frac{\sigma_{yy}^{n+1}(i,j)\sigma_{xy}^{n+1}(i,j-1)}{dy}\right) \quad (52)$$

When developing equation (52) we obtain:

$$v_x^{n+1}(i,j) = v_x^n(i,j) + \frac{dt}{\rho(i,j)}\left(\frac{\sigma_{xx}^{n+1}(i,j)-\sigma_{xx}^{n+1}(i-1,j)}{dx}+\frac{\sigma_{xy}^{n+1}(i,j)\sigma_{xy}^{n+1}(i,j-1)}{dy}\right) \quad (53)$$

In the y direction we obtain:

$$v_y^{n+1}(i,j) = v_y^n(i,j) + \frac{dt}{\rho\left(i+\frac{1}{2},j+\frac{1}{2}\right)}\left(\frac{\sigma_{yy}^{n+1}(i,j+1)-\sigma_{xx}^{n+1}(i,j)}{dy}+\frac{\sigma_{xy}^{n+1}(i+1,j)\sigma_{xy}^{n+1}(i,j)}{dx}\right) \quad (54)$$

where $\rho(i+1/2, j+1/2)=\{\text{fourth root}\}\sqrt{\rho(i,j)\rho(i+1,j)\rho(i,j+1)\rho(i+1,j+1)}$ Further details on the discretization of the FDTD band structure method can be found in the Tanaka paper (see above).

We claim:

1. A sound barrier, comprising: a first medium having a first density; and an array of structures disposed in the first medium, the structures being made of a second medium having a second density different from the first density, the array of structures being substantially periodic such that the first medium and array of structures made of the second medium form a phononic crystal, at least one of the first and second media being a solid medium comprising a viscoelastic material.

2. The sound barrier of claim 1, wherein the array of structures has a periodicity of not greater than about 30 mm in at least one dimension.

3. The sound barrier of claim 2, wherein each of the array of structures comprises an element no larger than about 10 mm in at least one dimension.

4. The sound barrier of claim 2 wherein each of the array of structures comprises a cylindrical element.

5. The sound barrier of claim 1, wherein the viscoelastic material is a viscoelastic silicone rubber.

6. The sound barrier of claim 5, wherein the other medium comprises a gas phase material.

7. The sound barrier of claim 1, wherein each of the first and second media has no acoustic resonant frequency from about 4 kHz or lower through about 20 kHz or higher.

8. The sound barrier of claim 1, wherein the other medium comprises a fluid.

9. The sound barrier of claim 1, wherein the substantially periodic array comprises a two-dimensional array.

10. The sound barrier of claim 1, wherein the substantially periodic array comprises a three-dimensional array.

11. A sound barrier, comprising: a first medium having a first density; and a substantially periodic array of structures disposed in the first medium, the structures being made of a second medium having a second density different from the first density, at least one of the first and second media being a solid medium comprising a viscoelastic material, the viscoelastic material having a combination of viscoelasticity coefficient and viscosity sufficient to produce an acoustic band gap from about 4 kHz or lower through about 20 kHz or higher, a transmission coefficient of longitudinal sound waves of frequencies within the band gap being not greater than about 0.05 when the barrier has a thickness of not greater than about 20 cm.

12. The sound barrier of claim 11, wherein the combination of viscoelasticity coefficient and viscosity, and the configuration of the substantially periodic array is sufficient to produce an acoustic band gap from about 4 kHz or lower through about 20 kHz or higher, a transmission amplitude of longitudinal sound waves for frequencies within the band gap being smaller by a factor of at least about 10 than a transmission amplitude of longitudinal sound waves for the frequencies through a reference sound barrier that has a homogeneous structure and has the same dimensions and made of an elastic or viscoelastic material having the same elastic properties as the medium comprising the viscoelastic material.

* * * * *